US006739817B2

(12) United States Patent
Rebora et al.

(10) Patent No.: US 6,739,817 B2
(45) Date of Patent: May 25, 2004

(54) BINDING DEVICE AND METHOD OF BINDING

(75) Inventors: Francesco Rebora, Genoa (IT); Marcello Vecchi, Milan (IT)

(73) Assignee: Prima S.r.l., Milan (IT)

( * ) Notice: Subject to any disclaimer, the term of this patent is extended or adjusted under 35 U.S.C. 154(b) by 0 days.

(21) Appl. No.: 09/843,662

(22) Filed: Apr. 26, 2001

(65) Prior Publication Data

US 2002/0051696 A1 May 2, 2002

Related U.S. Application Data

(63) Continuation of application No. PCT/IT99/00340, filed on Oct. 25, 1999.

(30) Foreign Application Priority Data

Oct. 26, 1998 (IT) ..... MI98A2293
Feb. 19, 1999 (IT) ..... TO99A0133

(51) Int. Cl.[7] ..... B42D 5/00

(52) U.S. Cl. ..... 412/33; 270/58.08; 412/7; 412/9; 412/38

(58) Field of Search ..... 412/1, 7, 9, 33, 412/38, 39, 40; 270/52.18, 58.08

(56) References Cited

U.S. PATENT DOCUMENTS 2,930,054 A * 3/1960 Bardy ..... 219/765
3,555,587 A * 1/1971 Seaborn ..... 226/43
4,537,545 A * 8/1985 Kunzmann ..... 140/92.4
4,610,590 A * 9/1986 Pigna ..... 412/11
5,015,138 A * 5/1991 Crudo et al. ..... 281/21.1
5,431,519 A * 7/1995 Baumann ..... 412/38
5,464,312 A 11/1995 Hotkowski et al.
6,062,792 A * 5/2000 Garrity ..... 412/1
6,074,152 A * 6/2000 Vecchi ..... 412/16
6,312,204 B1 * 11/2001 Spiel et al. ..... 140/71 C

FOREIGN PATENT DOCUMENTS

EP 304 411 2/1989

OTHER PUBLICATIONS

France, 749 885 A (Chene); Jul. 31, 1933; p. 2, Line 71 –p. 4, line 28; figures 1–6; Brevet D'Invention.

* cited by examiner

*Primary Examiner*—Monica S. Carter
(74) *Attorney, Agent, or Firm*—Kenneth L. Sherman, Esq.; Myers Dawes Andras & Sherman; Vic Y. Lin, Esq.

(57) ABSTRACT

Binding device wherein a support structure (2) houses a pack of sheets provided with through-holes (133) aligned along a rectilinear edge of the pack. The structure moreover carries a binding member comprising a flat sheet-like rectangular member (100) showing, along a side thereof **(100*a*), a plurality of flexible tongues (107) arranged combwise and a closure member (110) extending along the side (100*a*). The binding device is provided with a bending wall (70) mobile with respect to the pack and adapted to realize the bending of tongues portions projecting from the pack on an end flat member forming a first face of the same pack. A pressing device (90) further realises bending of the closure member (110) to arrange the closure member (110) on bent tongues (107) and on the end flat member (130*b*)** thereby forming a bound fascicle.

31 Claims, 15 Drawing Sheets

Fig.2
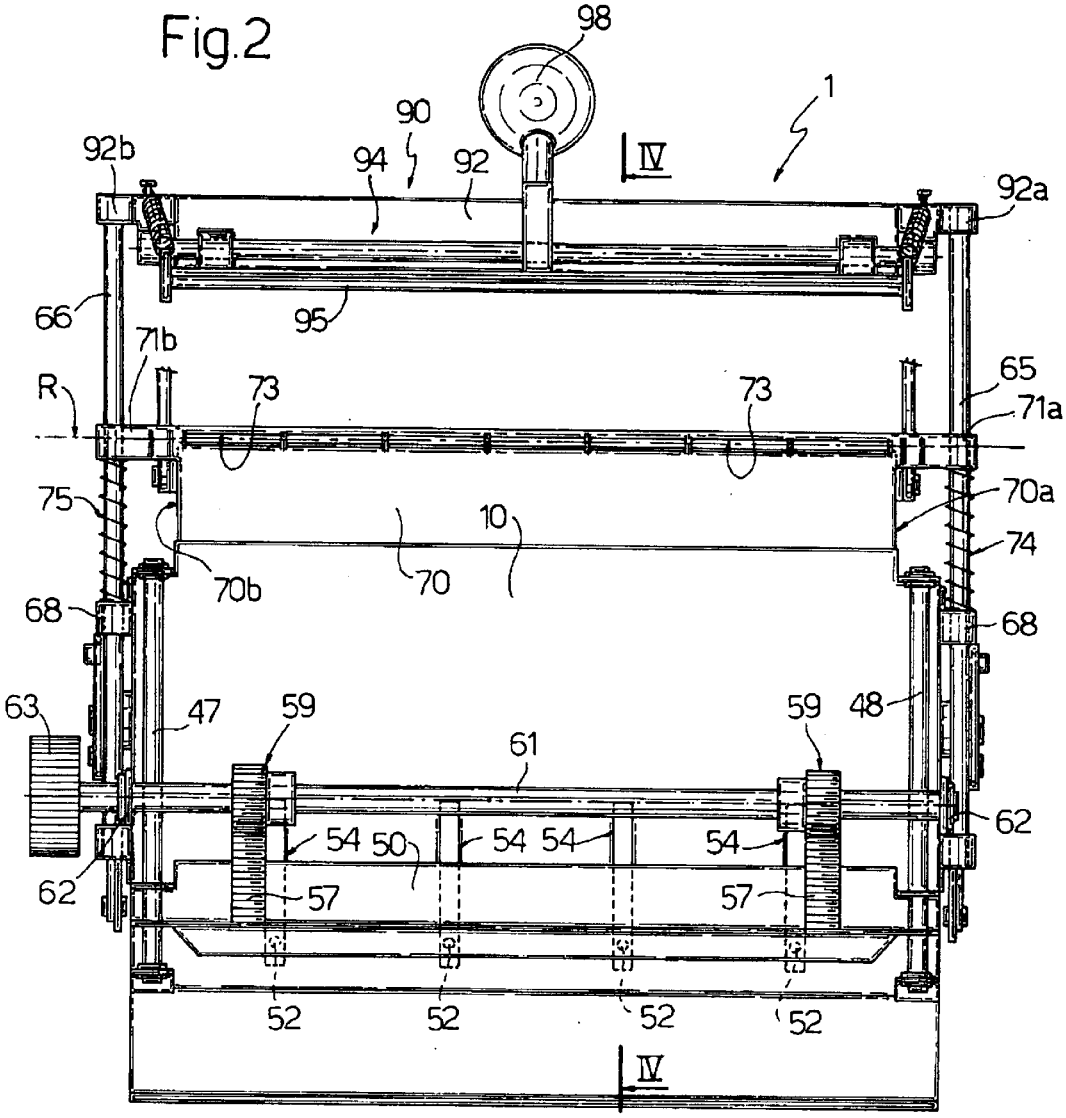
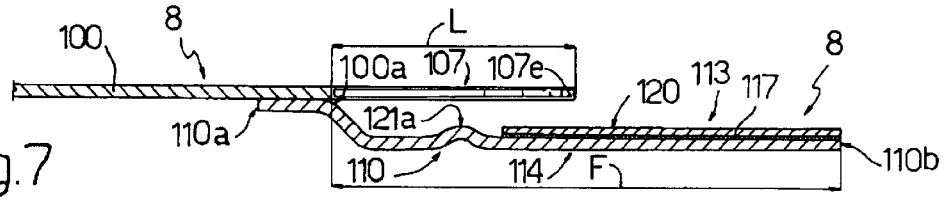
Fig.7

328
333
327
T
317
335
320
Td
342b
1c
337
342
342a
340b

380a
Tc
306
4
310
381
383
315
302
304
380
MS
348
350
346
340
340a
357
300
357
308
355
352
344d
312
309
SP
344
360
358
344r

BINDING DEVICE AND METHOD OF BINDING

CROSS-REFERENCE TO RELATED APPLICATION

This is a continuation of International Application PCT/IT99/00340, with international filing date of Oct. 25, 1999, which designated the United States.

TECHNICAL FIELD

The present invention relates to a binding device and method.

BACKGROUND ART

As is known, to bind sheets arranged as a pack and stabbed along a outer edge of the pack, binding members are used having a substantially tubular arrangement comprising an elongated edge portion showing a substantially-C shaped transverse section and a plurality of curved tongues integrally realised with the edge portion and mutually spaced one another so as to form a comb-shaped resilient structure.

To arrange the above mentioned binding members on a pack of sheets, binding devices are used (that can be manually operated or of the motorised type) adapted to simultaneously bend all curved resilient tongues, thereby allowing to introduce the tongues inside the holes; such devices subsequently close the tongues that go back to the previous elastically undeformed position, being thereby arranged with their own end portion abutting on an internal surface of the edge portion. A bound fascicle is in such a way obtained wherein each tongue is inserted in a respective pack hole and crosses the same pack, and is arranged with its own end portion abutting on the internal surface of the edge portion thereby realising a stable connection among the sheets.

The binding devices of the above known types show a plurality of drawbacks among which:

- the sheets are inserted in the combwise resilient structure arranging in succession small packs of sheets and afterwards closing the comb-shaped resilient structure-such operation must be manually carried out and is rather time consuming; and
- the comb-shaped resilient structure must be correctly placed on the binding device in order to allow engagement of every resilient tongue with a respective grip member adapted to be coupled with the same tongue to open the comb-shaped resilient structure.

The product too, i.e. the bound fascicle, realised with such binding devices, shows a series of drawbacks among which:

- the elongated edge portion frontally and laterally projects from the fascicle; for such a reason it is often difficult to arrange the fascicle inside a shelf, or approach it to other bound fascicles or envelop the bound fascicle and mail it;
- it is not generally possible to put writings and legends by printing the frontispiece of the bound fascicle since this area is formed by the external surface of the edge portion that is curved and is made of plastic material;
- the binding device (made of plastic material) must be separated from the pack of sheets when the fascicle must be disposed of, for example incinerated;
- binding members of different sizes are necessary to bind fascicles with a different number of sheets and therefore with different thickness.

- the binding member (made of plastic materials) can become fragile with time; and
- the tongues (made of plastic material) slide in the rectangular sheet holes; such sliding (among parts made or different materials) can damage the hole edges and therefore the integrity of the same sheets.

DISCLOSURE OF INVENTION

Object Of the present invention is to achieve a device allowing to bind sheets arranged in a pack which solves the drawbacks of the known devices and with which a bound fascicle can be formed thus solving the known drawbacks of bound fascicles.

These and other features and advantages of the invention will be apparent to those skilled in the art from the following detailed description of preferred non-limiting embodiments, taken together with the drawings, in which:

BRIEF DESCRIPTION OF THE DRAWINGS

FIG. 2 shows, in a front view, the binding device of the present invention;

FIG. 7 shows a section of the binding member realised according to plane VII—VII of FIG. 6;

BEST MODE OF CARRYING OUT THE INVENTION

Figure 1:
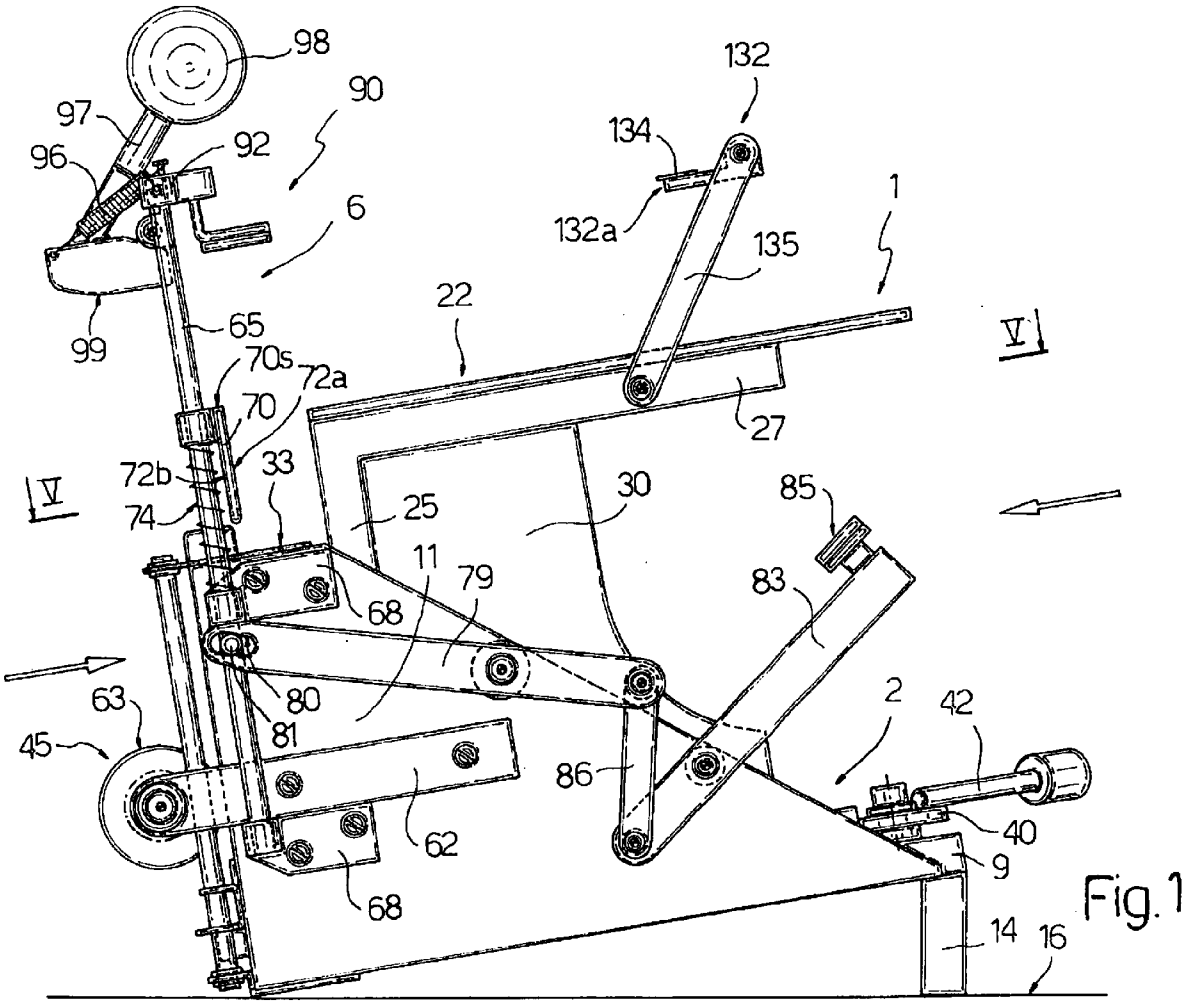
FIG. 1 shows, in a side view, a binding device realised according to the teachings of the present invention.
Figure 3:
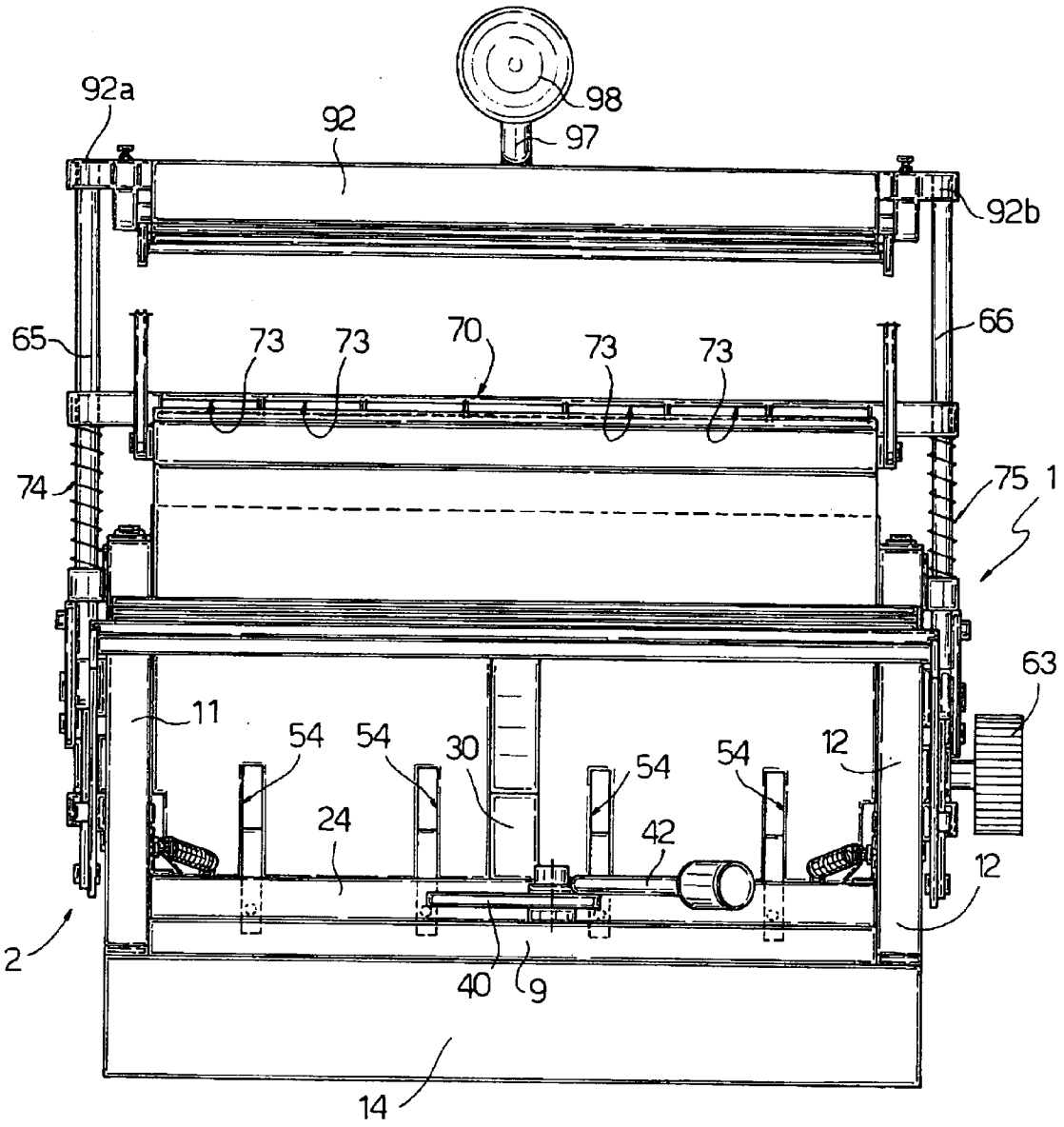
FIG. 3 shows, in a rear view, the binding device of the present invention.
Figure 4:
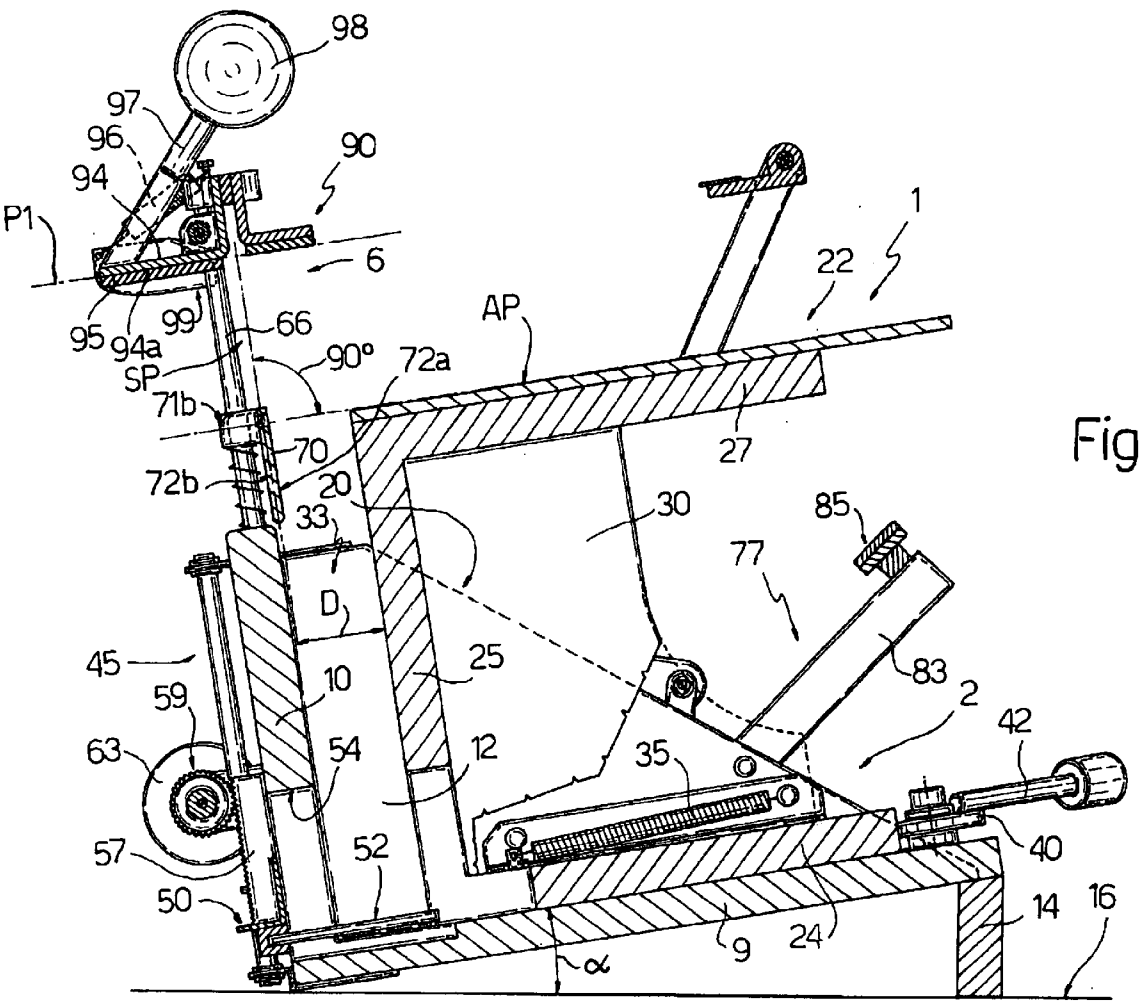
FIG. 4 shows a sectional view of the binding device obtained according to plane IV—IV in FIG. 2.
Figure 6:
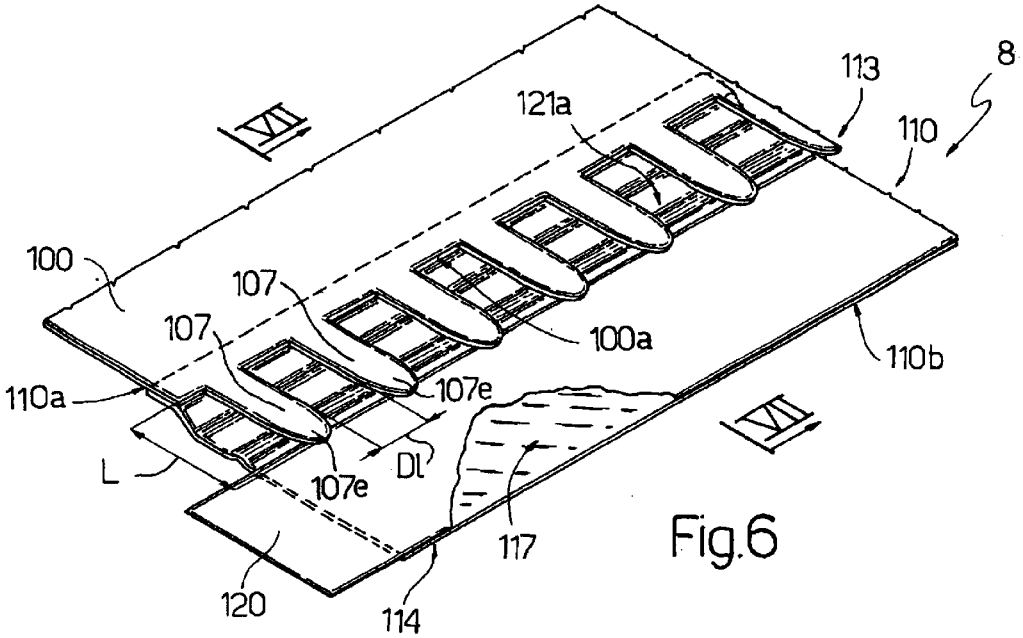
FIG. 6 shows, in a perspective view, a first binding member that can be used with the binding device of the present invention.

In FIGS. 1 and 4 numeral 1 shows, as a whole, a binding device comprising a support structure 2 for a pack of sheets 4 (FIG. 8) and a bending device 6 able to be manually operated and adapted to realise bending of a binding member 8 (FIGS. 6 and 7) with which the pack of sheets 4 is bound.

Particularly, the support structure 2 comprises:

a base wall 9 that is substantially rectangular and flat;

a front wall 10 that is substantially rectangular and flat arranged perpendicular to base wall 9 and extending along a front outer edge of the base wall 9;

two lateral edge walls 11, 12 shaped in a rectangular trapezoid, each one having its outer portion corresponding to the shorter straight side attached to a shorter side edge of the front wall 10 and the outer portion corresponding to the longer straight side attached to a lateral outer edge of the base wall 9; and a rectangular wall 14 extending along a rear outer edge of the base wall 9 on the opposite side of the front wall 10 (FIG. 4).

The support structure 2 abuts against an horizontal plane 16 with a front portion of the base wall 9 and with an end portion of the rectangular wall 14 in such a way that the rectangular base wall 9 is arranged slanted with respect to the horizontal plane 16 and forms therewith an angle $\alpha$ of about 15°.

The support structure 2 defines a space 20 that is laterally constrained by walls 11, 12, frontally by wall 10 and downwards by wall 9; in such a space 20 a slider 22 operated with a manual control slides with an alternate rectilinear motion.

In particular, the slider 22 shows a C-shaped transversal section (FIG. 4) and comprises:

a rectangular flat base wall 24 overlapping the and sliding on the base wall 9;

a rectangular flat front wall 25 perpendicular to the base wall 24 and extending along a front edge of the base wall 24; and a flat rectangular bearing wall 27 arranged parallel to base wall 24 and extending along an upper front edge of the front wall 25 along the same direction to which the wall 24 extends. The slider 22 further includes a central stiffening wall 30 connected with central portions of the base wall 24, of the front wall 25 and of the bearing wall 27.

The front wall 10 or the support structure 2 and the front wall 25 of the slider 22 are therefore mutually facing one another and define from opposite sides a variable-volume space 33 that is limited, among others, by lateral edge walls 11, 12 and by base wall 9.

More particularly, the slider 22 is mobile from a rear rest position in which the front walls 10, 25 are mutually spaced by a length D to a front operation position (FIG. 8) wherein the front walls 10, 25 are mutually spaced by a length d smaller than length D. In this way, the space 33 shows a variable size (volume) depending on the position of the slider 22 with respect to the support structure 2.

Figure 5:
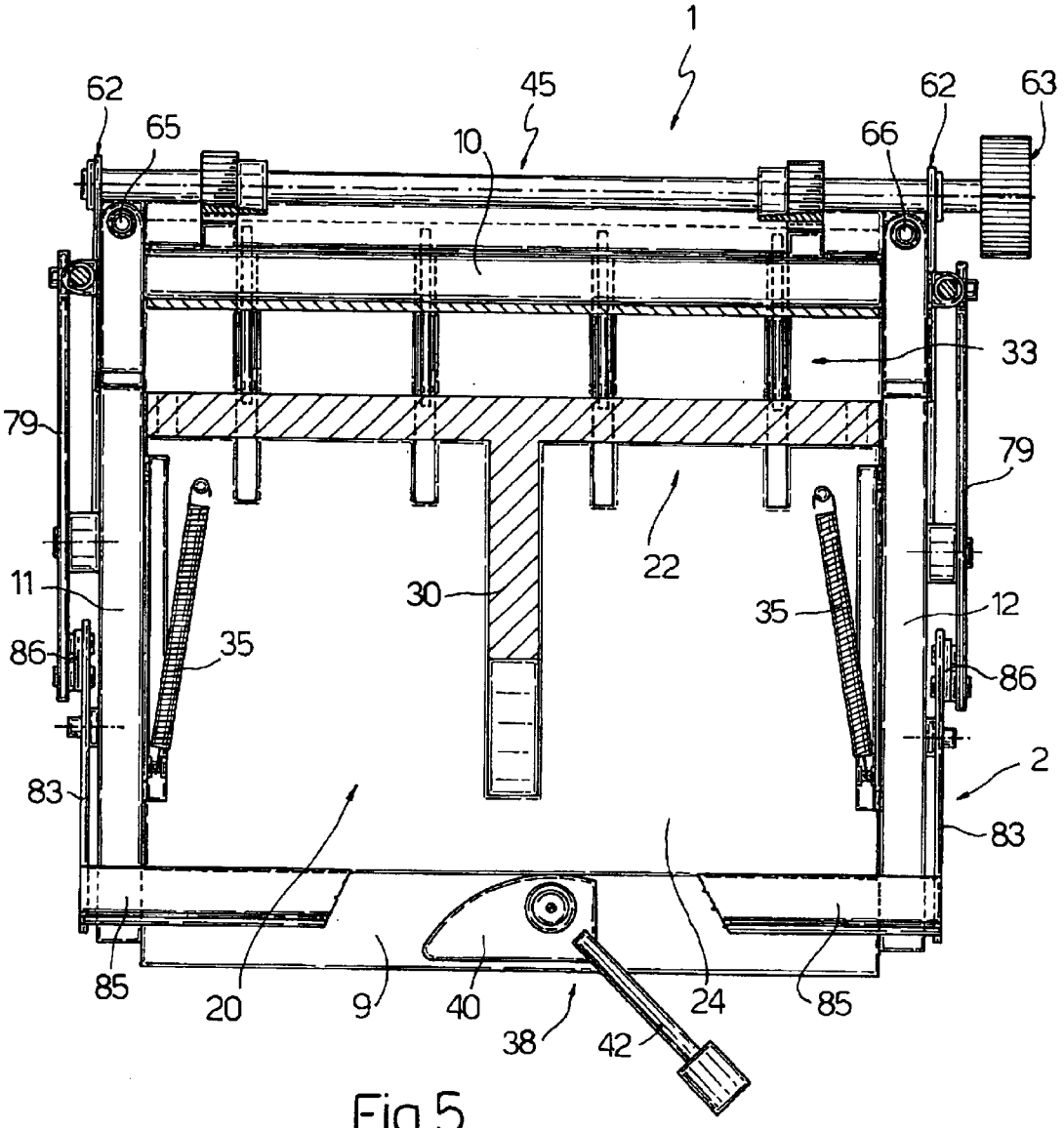
FIG. 5 shows a section of the binding device obtained according to plane V—V in FIG. 1.

The slider 22 is usually kept in the rest position by the resilient action of two helical springs 35 respectively interposed (see FIG. 5) between the base wall 24 of the slider 22 and the side edge walls 11, 12 of the support structure 2.

The slider 22 is further mobile from the rear rest position to the front position under the thrust of a cam device 38 (FIG. 5) including a triangular plate 40 provided with a control lever 42 and hinged to a rear portion of the base wall 9; the plate 40 has a curved larger side arranged in contact with a rear edge of the base wall 24 to apply, following the rotation of plate 40, a force to the slider 22 and push it to the front operation position against the resilient action of the springs 35, 36.

A device 45 is further provided for the vertical position of the pack of sheets 40 taken from the front wall 10 externally to the support structure 2 and comprising (FIG. 2):

two rectilinear columnar guides 47, 48 projectingly taken from the front wall 10 and arranged along sides of a smaller side of the front wall 10;

a slider 50 looking towards the front wall 10 and showing end portions sliding along columnar guides 47, 48; and a plurality of bearing rods 52 taken by the slider 50 and extending inside the space 33 through respective rectangular slits 54 formed in the front wall 10.

The slider 50 is integral with two racks 57 arranged parallel to columnar guides 47, 48 and looking towards the outside of the structure 2; each rack 57 engages a gear wheel 59 arranged on a shaft 61 extending perpendicularly to the columnar guides 47, 48 and showing opposite ends supported by brackets 62 attached to lateral edge walls 11, 12. The shaft 61 is provided, at one end thereof, with a knob 63 (FIGS. 1 and 5) that can be manually gripped to realise the rotation of the same shaft 61 and therefore, through the coupling between gear wheel 59 and rack 57, the rectilinear displacement with opposite directions of the slider 50 along the columnar guide 47, 48. The above-said displacement of the slider 50 generates the displacement of the bearing rods 52 inside the space 33 and therefore the moving away from and the approaching to the base wall 9 of the bearing rods 52.

The bending device 6 comprises a pair of cylindrical rods 65, 66 each one being supported by a respective lateral edge wall 11, 12 of the support structure 2 and being fixed thereto by means of metal brackets 68 with respect to which the rod 65, 66 can axially slide. The cylindrical rods 65, 66 extend parallel one to the other and perpendicular to the base wall 9 of the support structure 2 and to the bearing wall 27 of the slider 22. The bending device 6 further includes a bending wall 70 having a rectangular flat shape which shows opposite portions of a shorter side 70*a*, 70*b* integral with appendixes 71*a*, 71*b* sliding along respective rods 65, 66 in such a way that the bending wall 70 is slidable along a sliding plane SP (FIG. 4) that is perpendicular to the bearing plane AP defined by the bearing wall 27 of the slider 22. The bending wall 70 (FIGS. 1 and 4) further shows a first face 72*a* facing the front wall 25 of the slider 22 and a second face 72*b* facing the front wall 10 of the support structure 2. The bending wall 70 (FIGS. 1 and 4) further shows a first face 72*a* facing the front wall 25 of the slider 22 and a second face 72*b* facing the front wall 10 of the support structure 2.

The bending wall 70 further shows a plurality of rectangular through-grooves 73 (FIG. 2) arranged aligned along a rectilinear direction R parallel and adjacent to a larger side upper edge 70*s* of bending wall 70.

Each cylindrical rod 65, 66 carries an helical spring 74, 75 assembled coaxial on the same rod and showing opposite ends arranged in abutment with an appendix 71*a*, 71*b* and with a shoulder of a metal bracket 68. The springs 75, 76 are adapted to carry the bending wall 70 to an upper rest position in which the rectilinear direction R is coplanar with the bearing plane AP and the bearing plane AP intersects the aligned rectilinear through-grooves 73.

The bending device 6 further comprises a lowering device 77 of the wall 70 which includes:

- a pair of first rectilinear elements 79 each showing an intermediate portion hinged to the lateral edge wall 11, 12 of the support structure 2 and a first end portion showing a slot 30 (FIG. 1) engaged by a stake 81 radially extending from a cylindrical rod 65, 66;
- a pair of second rectilinear elements 83 hinged to respective lateral edge walls 11, 12 of the support structure 2 and showing first end portions mutually linked by a crossbar 85; and
- a pair of rectilinear interception elements 86 showing end portions hinged to the second end portions of the first rectilinear elements 79 and the second rectilinear elements 83.

The above-said rectilinear elements realise a cinematism whereby the displacement of the crossbar 85 towards the base wall 9 (lowering) produces the displacement of slots 80 towards the base wall 9 and therefore the displacement (lowering) from the bending wall 70 towards the base wall 9 contrasting the resilient action of the springs 74, 75 that are compressed. Following such operation, the through-grooves 73 are arranged in a lower operation position and thus they are no longer coplanar to the bearing plane AP and are spaced therefrom by a pre-set distance.

By releasing the crossbar 85, the resilient action of the springs 75, 76 that were previously compressed takes the bending wall 70 back to the upper rest position mentioned above wherein the rectilinear direction R is coplanar with the bearing plane AP and the bearing plane AP intersects the aligned through-grooves 73.

The bending device 6 further includes a pressing device 90 comprising a rectilinear interconnection element 92 (FIG. 2) showing opposite end portions 92*a*, 92*b* that are stably fixed to end portions of the cylindrical rods 65, 66 and a shaped wall 94 hinged to the rectilinear element 92, facing the outside of the support structure 2 and showing a cross section substantially "L" shaped with a flat larger portion 94*a*, covered by a flat layer 95 made of soft material.

The wall 94 is coupled with a spring 96 (FIG. 1) extending between this latter one and the rectilinear interconnection element 92 and is angularly mobile between a rest position (shown in FIGS. 1, 2 and 4) according to which the flat layer 95 is substantially coplanar with a parallel plane P1 to the bearing plane AP and an operation position (shown with dashed lines in FIG. 4) according to which the flat layer 95 is substantially coplanar with the sliding plane SP on which the bending wall 70 rests.

The wall 94 is coupled to a rod 97 that extends from a central portion thereof from the opposite part of the layer 95 and shows, at one end thereof, a knob 98 that can be grasped and used to manually displace the wall 94 from rest position to the operation position.

The wall 94 moreover supports, at its rest portions, two portions 99 each defining a cam profile adapted to be coupled with the modes that will be explained below, with the appendixes 71*a*, 71*b* of the bending wall 70.

The bending device 1 can be used together with a binding element 8 (FIG. 6) comprising a sheet rectangular-like shaped flat element 100 showing, along a rectilinear larger side 100*a* thereof, a plurality of flexible tongues 107 arranged as a comb. It is anyway clear how the tongues 107 could also extend on a shorter side of the flat sheet element 100. Preferably, the tongues 107 are realised integral with the flat sheet element 100 through die cutting.

The flat sheet element 100 can be realised through die cutting process of a cardboard sheet, of a sheet made of plastic material (for example transparent plastic material) or of a sheen made of metal materials (for example a flexible aluminium sheet). It is anyway clear that the flat sheet element 100 can be realised in different materials adapted to anyway guarantee a sufficient flexibility of the tongues 107.

The tongues 107 are arranged spaced one from the other along the longer rectilinear side 100*a* with a constant pitch D1 (FIG. 6) and show the same length L. Each tongue 107 perpendicularly extends to the side 100*a* and has a rectangular shape with a rounded free shorter side end 107*e*.

A binding element 8 further comprises a shaped band closure element 110 extending along the whole larger rectilinear side 100*a* of the flat element 100 and preferably made of the same material as the flat element 100; in particular, the closure band 110 has a rectangular perimeter and comprises a first larger rectilinear edge portion (FIG. 7) 110*a* glued to the flat sheet element 100 along the rectilinear larger side 100*a* and two smaller edges (FIG. 6) arranged aligned with the smaller sides of the rectangular flat element 100.

The closure band 110 shows an application surface 113 facing the tongues 107 and a surface 114 oriented on the side opposite to the tongues 107.

The application surface 113 carries a gluing band 117 that extends along a second larger rectilinear edge portion 110*b* of the band 110; the gluing band 117 is provided with a protection band 120 of the removable type. Preferably the gluing band 117 is a both sides adhesive tape arranged on the closure band 110 along the larger rectilinear edge 110*b*.

The gluing band 117 could also be normally solid and thermally formable; in this case the protection band 120 could be not necessary.

The closure band 110 (FIG. 7) further has a useful width F (measured between the second edge portion 110*b* and the side 100*a*) greater than the length L of each tongue 107 in such a way that the end portion 107*e* of each tongue 107 is arranged lacing the application surface 113 when the band 110 is not distorted and is substantially flat. The closure band 110 could be further made of a fabric.

The closure band 110 further has one (or more) preferential bending line 121*a* that extends for all its length parallel to the larger edges 110*a* and 110*b* of the band 110 and to side 100*a* of the flat sheet element 100. The Preferential bending line 121*a* extends on a portion of surface 113 that is not covered by adhesive material. It is understood that bending lines could not be present.

In order to use the device according to the present invention, a pack 4 of rectangular sheets 131 (FIG. 8) has a set of rectangular holes 133 extending along a larger rectilinear edge 130*e* of pack 4. Pack 4 is delimited, on opposite faces, by flat end elements 130*a*, 130*b* preferably made of a semi-rigid element (for example a cardboard) and a sheet.

When the slider 22 is arranged in the rear rest position, a pack 4 of sheets 131 is inserted in the space 33 and is arranged with its own rectilinear edge opposite to the edge 130*e* arranged on the bearing rods 52. The flat end element 130*a* is arranged facing the front wall 10 of the support structure and the flat end element 130*b* is arranged facing the front portion 25 of the slider 22.

The slider 22 is then taken, by manually rotating the control lever 42, towards the front operation position, thereby realising the displacement of the pack 4 towards the front wall 10.

In the front operation position, the walls 10 and 25 are spaced one from the other by a distance d that is adjustable by operating on the control lever 42 and modifying the position of the slider 22 inside the support structure 2. The position of the slider 22 is anyway adjusted in such a way that the distance between the flat element 130*a* and thin wall 10 is substantially equal to the thickness of the bending wall 70.

Thereafter, the vertical position of pack 4 can be adjusted by operating on the knob 63 in such a way that the pack 4 can be moved away from/approached to the base wall 9. Such adjustment operation is performed in order to align the holes 133 of the pack 4 with the rectilinear grooves 73 of the bending wall 70; once the alignment -position has been reached the holes 133 of the pack extend along a rectilinear direction that is substantially coplanar with the bearing plane AP and is parallel to direction R (FIG. 8*a*) The closure element 8 is then arranged on the slider 22 with the flax sheet element 100 resting on the wall 27 and arranged substantially coplanar with AP plane; in such a position, moreover, the tongues 107 extend towards the pack 4 and the bending wall 70. The closure element 110 is further facing outwards of the support structure 2 and arranged with the larger rectilinear edge 110*b* facing pack 4 and bending wall 70. The flat sheet element 110 is further moved towards pack 4 in such a way that each tongue 107 penetrates inside a respective hole 133 of pack 4 and further engages the groove 73 of the bending wall 70 going out from same groove 73. In this way, tongues 107 engage the bending wall 70 since every tongue crosses pack 4 going out from the bending wall 70 arranged in the upper rest position.

Figure 8:
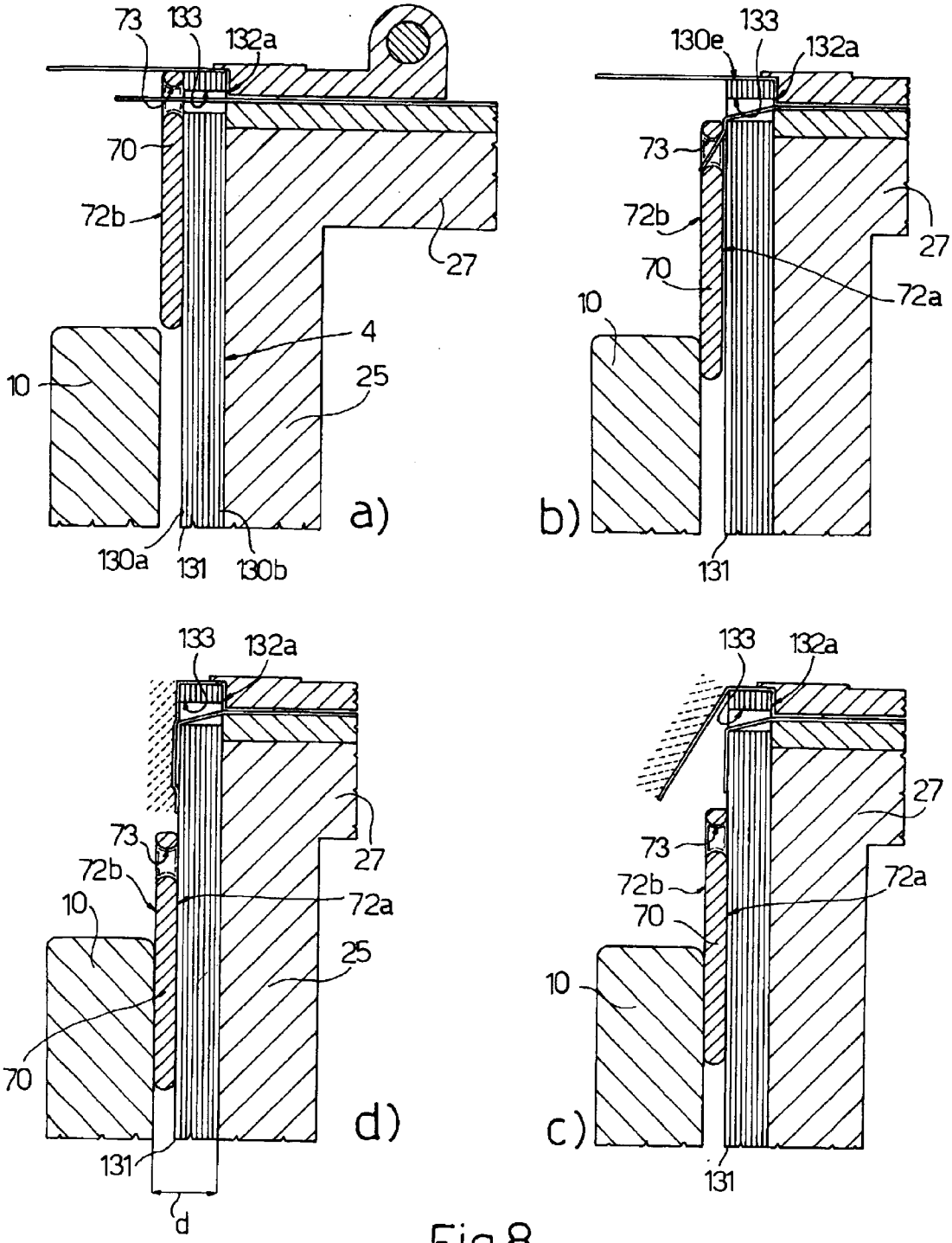
FIGS. 8*a*, 8*b*, 8*c* and 8*d* show subsequent bending steps of the binding members in FIG. 6, realised with the binding device object of the present invention.

The position of the binding element 8 is stably kept during binding operations through a striker device 132 (FIGS. 1 and 8) that is arranged, in one of the activation positions thereof shown in FIG. 8, with one shoulder 132*a* abutting against the closure element 110*a* preventing every translation movement thereof on the bearing plane AP; in particular the striker device 132 comprises a rectilinear element 134 defining the above-said shoulder and having opposite ends hinged to first arms ends 135 (FIG. 1) and having second ends hinged to the bearing wall 27.

The crossbar 85 is then lowered producing the movement of the bending wall 70 towards the base wall 9 and lowering of tongues 107 that are bent and arranged in contact with the flat end element 130*a* by the action of the bending wall 70. Once the lower operation position has been reached, the tongues 107 are bent and arranged for a section in contact with the flat end element 130*a* and have an end portion still contained inside the grooves 73; in such a position the closure element 110 has not yet been sent (FIG. 8*b*). Thereafter, by operating on the knob 98, the wall 24 is rotated from the upper rest position towards the operation position and engages the closure element 110 that comes into contact with the flat status 95 and is bent towards the bending wall 70 and the pack 4 (FIG. 8*c*). Simultaneously, the cam portions 99 come in contact with the appendixes 71*a*, 71*b* and the bending wall 70 is further pushed towards the base wall 9 by the action of springs 74, 75 and beyond the lower operation position. In this way, the simultaneous action of putting each tongue 107 in contact with the flat end element 130*a* is realised for the whole length of the tongue protruding from pack 4 and putting the gluing band 117 (from which the protection band 120 has been previously removed) in contact with the bent tongues 107 and with the flat end element 130*a* whereto the closure element 110 stably adheres (FIG. 8*d*).

As previously mentioned, the flat element 130*a* that constitutes the second face of rack 4 is preferably made of a sufficiently stiff material, for example cardboard or plastic material. In this way, the gluing material 117 makes a stable connection between the band 110 and the flat element 130*a* and therefore connection is guaranteed between this latter one and the flat element 100 while sheets 131 of pack 4 are stably retained between the flat element 130*a* and the flat sheet element 100 that respectively form the rear and front cover of a bound fascicle.

Figure 11:
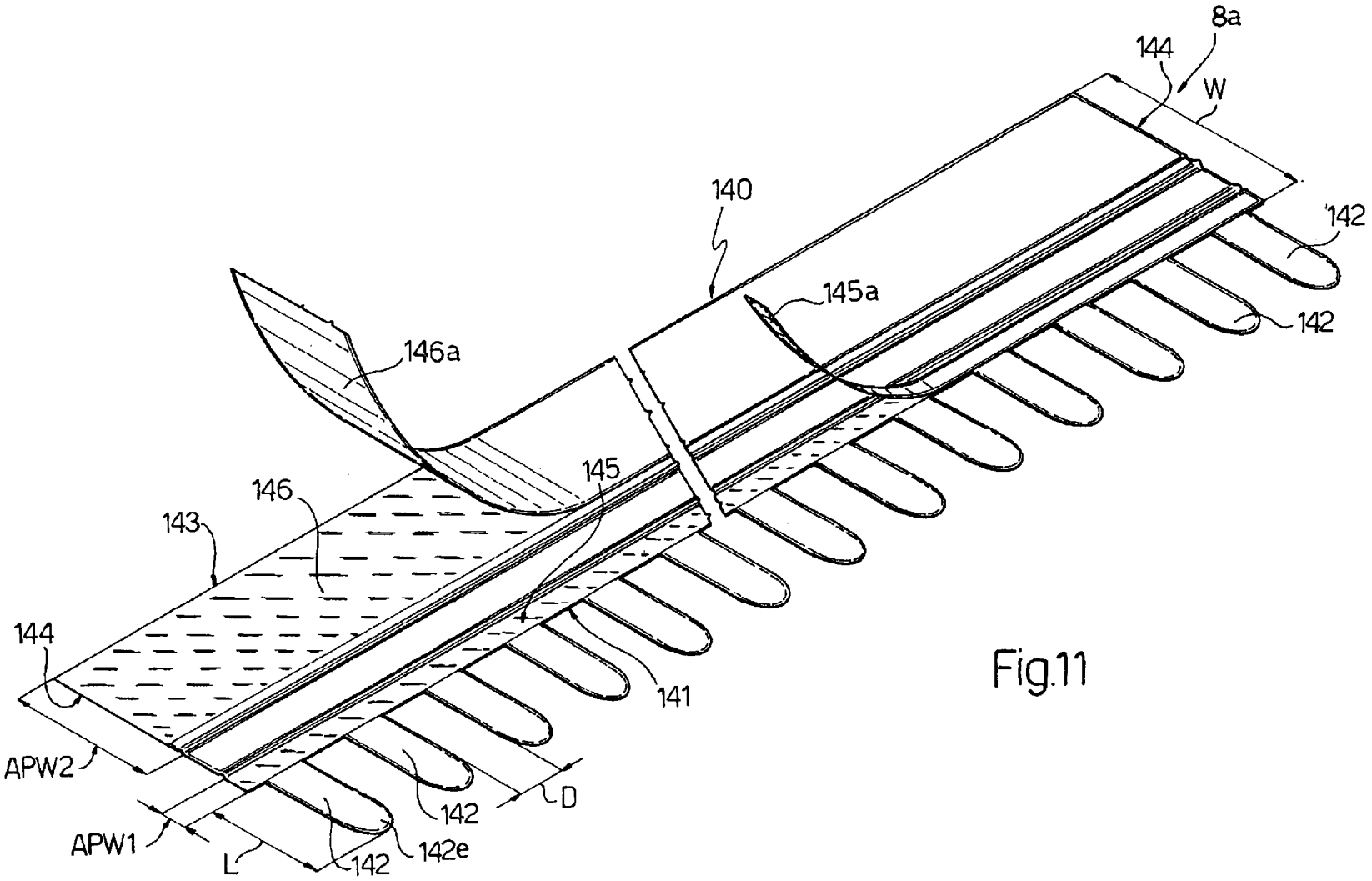
FIG. 11 shows, in a perspective view, a second binding member that can be used alternatively to the binding member in FIG. 6.

In alternative to the binding element 8 described above, a different binding element 8*e* shown in FIG. 11 could also be used.

Such binding element 8*a* comprises a rectangular-shaped band element 140 having, along a first rectilinear larger side edge 141 thereof, a plurality of flexible tongues 142 arranged combwise. Preferably the tongues 142 are realised integral with the band element 140 by means of die cutting.

The band element 140 can be formed by die-cutting a cardboard sheet, a sheet made of plastic material or fabric, a sheet made of metal material (for example a flexible aluminium sheet).

The tongues 142 are arranged spaced one from the other along the rectilinear larger edge 141 with a constant pitch D1 (FIG. 11) and have equal length L. Each tongue 142 extends perpendicularly to the rectilinear edge 141 and has a rectangular shape with, a free rounded shorter side end 142*e*.

The rectangular band element 140 is further limited by a second rectilinear longer side edge 143 and two rectilinear shorter side edges 144.

The band element 140 has a first application surface (or portion) 145 extending along the first rectilinear edge 141 for the whole length of the same edge 141; such first application portion 145 is substantially flat and has elongated rectangular shape with a width, measured perpendicularly to the rectilinear edges 141, 143, equal to APW1. Such width APW1 is smaller than width W of the rectangular band element 140. The first application portion 145 is further covered with gluing material and is provided with a band 145*a* of the removable type to protect the gluing material.

The band element 140 also has a second application portion 146 extending along the second rectilinear edge 143 for the whole Length of the same edge 143; such second application portion 146 is substantially flat and has an elongated rectangular shape, with the width, measured perpendicularly to rectilinear edges 141, 143, being equal to APW2. Width APW2 is smaller than width W of flat band element 140 and is greater than width APW1.

The second application portion 146 is moreover covered with gluing material and is provided with a band 146*a* of the removable type to protect the gluing material.

The first application portion 145 and the second application portion 146 are further laterally separated and spaced one from the other by an intermediate rectangular portion of the band element 140 lacking of gluing material. The first application portion 145 and the second application portion 146 are further arranged on the same face of the band element 140.

To use the device according to the present invention with the binding element 8*a*, after having adjusted the vertical position of the pack 4 of sheets (FIG. 12), the slider 22 is taken to the front operation position thereby approaching the pack of sheets to the front wall 10.

The band element 140 (FIG. 12*a*) is arranged substantially coplanar with bearing plane AP with the tongues 142 facing the holes 133 and the application portions 145, 146 facing upwards; thereafter, each tongue 142 is inserted inside a respective hole 133 of the pack 4 and engages the groove 73 of the bending wall 70 going out from the same groove 73.

The band element 140 is then gripped along its second larger rectilinear edge 143 and is rotated by 90° to arrange the second application portion 145 (from which the protection band 145*a* has been removed) in contact with the portion of pack 4 extending between the holes 133 and a rectilinear corner of the same pack (FIG. 12*b*). The band element 140 is further rotated (FIG. 12*c*) until the second application portion 146 is arranged on a plane substantially parallel to bearing plane AP.

Simultaneously or after the above mentioned operations, the crossbar 85 is then lowered thus lowering the tongues 142 that are bent and arranged in contact with the flat end element 130*a* by the action of the bending wall 70. Once the lower operation position has been reached, the tongues 142 are bent and arranged in contact with the flat end element 130*a* and have end portions going out from grooves 73; in such a position the second application portion 146 has not yet been bent (FIG. 12*c*). Thereafter, by operating on the knob 98 the wall 24 is rotated in such a way that the second application portion 146 is bent towards the pack 4, thus putting the second application portion 146 (from which the protection band had been previously removed) in contact with the bent tongues 142 and with the flat end element 130*a*.

A bound fascicle is thereby formed by the binding elements 8*a*.

Figure 9:
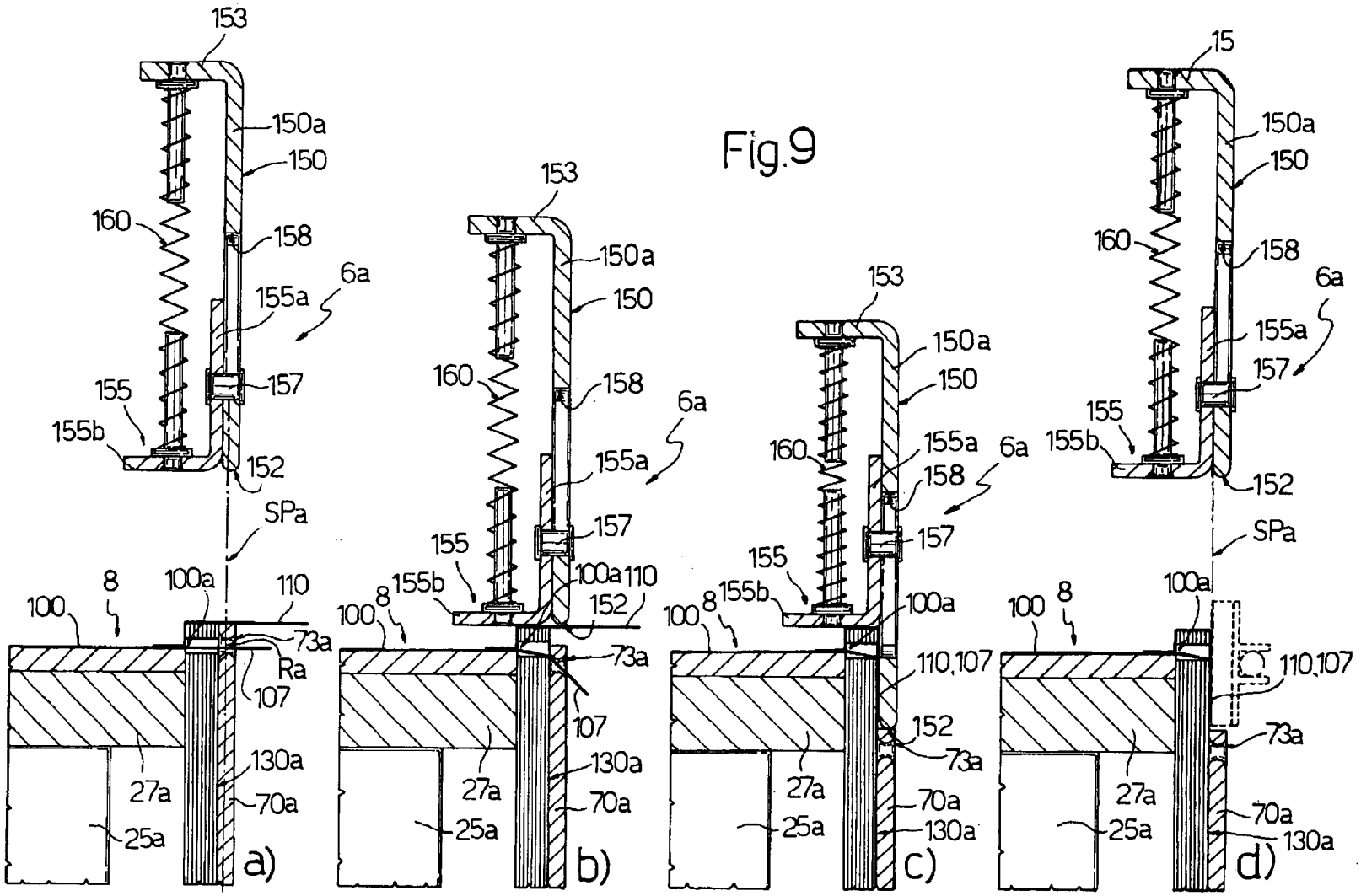
FIGS. 9*a*, 9*b*, 9*c* and 9*d* show, in a schematic way, a first variation of the binding device in FIGS. 1–5.

FIG. 9 shows a variation to the binding device in FIGS. 1–5. For the sake of simplicity, the following description will only show parts that are fundamentally different from the corresponding parts of the previously described binding device 1. Parts whose structure or function are similar will be denoted by the same reference numeral and additional alphabetic character (a) while parts having different shape and/or function will be denoted by new numerals.

The binding device in FIG. 9 comprises a binding device 6*a* including a bending wall 70*a* that moves along the sliding plane SPa following a manual command; the bending wall 70*a* is provided with a plurality of trough grooves 73*a* arranged along a rectilinear direction Ra and adapted to house the tongues 107 to bend the tongues 107 during the translation motion from the bending wall 70*a* from the upper rest position to the lower operation position. In this case, pressing device 90*a* comprises a second bending wall 150 which is carried by support devices (not shown) to move along the sliding plane SPa. In particular, the wall 150 comprises a rectangular flat portion 150*a* showing a first longer side edge 152 adjacent to a corresponding upper edge of the binding wall 70*a* and spaced with respect thereto and a flange 153 extending integrally along a second larger side end of the rectangular flat portion 150*a*. The edge 152 further shows a circular-arc-shaped transverse section.

The second banding wall 150 further carries an L shaped wall 155 comprising a firs flat rectangular portion 155*a* arranged on the rectangular flat portion 150*a* and sliding with respect to the latter and a second rectangular flat portion 155*b* integral with the first one and perpendicular with respect to the latter. The L shaped wall 155 is provided with appendixes 157 that extend from the same wall 155 and across respective rectilinear slots 158 of the wall 150 to realise the above said sliding between walls 150 and 155. A helical spring 160 is further interposed between the flange 153 and the second rectilinear flat portion 155*b*.

During use, with reference to binding operations performed by bending device 6*a* together with the binding element 8; the bending wall 70*a* is lowered following a manual command thereby lowering and bending the tabs 107 that are arranged in contact from the flat end element 130*a* by the action of the bending wall 70*a* (FIG. 8*b*). Following a further manual command, moreover, the second bending wall 150 is further displaced downwards, and when the first bending wall has reached the lower operation position, it is arranged with the edge 152 next to the bending wall 70*a*; in such a position the edge 152 intersects the closure element 110 (FIG. 8*b*) and in its following stroke downwards the second bending wall 150 bends the closure element 110 arranging it on the flat end element 130*a* (FIG. 8*c*) and simultaneously pushes the bending wall 70*a* downwards thus completing the bending of tongues 107. During the above said operations, the second rectilinear portion 155*b* presses the closure element 110 ensuring the correct overlapping thereof on the pack of sheets 4.

In this way, similarly to what has been previously said, the gluing material 117 makes a stable connection between the band 110 and the flat element 130*b* and thus the connection is guaranteed between this latter one and a flat element 100 while the sheets 131 of the pack 4 are stably kept between flat element 130*b* and a flat sheet element 100 that, respectively, form the rear and front cover of a bound fascicle.

Figure 12:
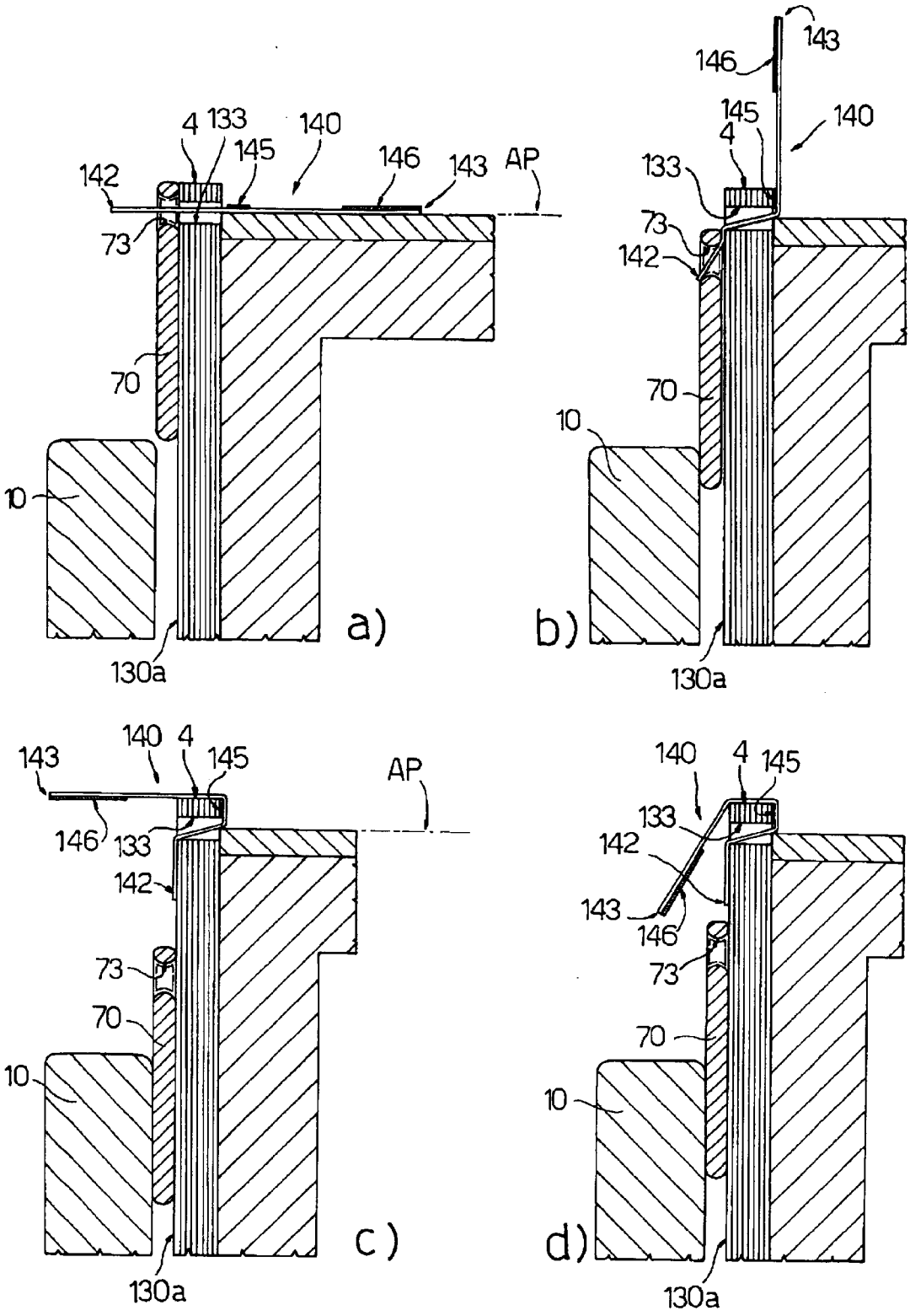
FIGS. 12*a*, 12*b*, 12*c* and 12*d* show subsequent bending steps of the binding member in FIG. 11 realised with the binding device object of the present invention.

Should a binding element 8*a* be used, operations similar to those shown in FIG. 12 are performed.

Figure 10:
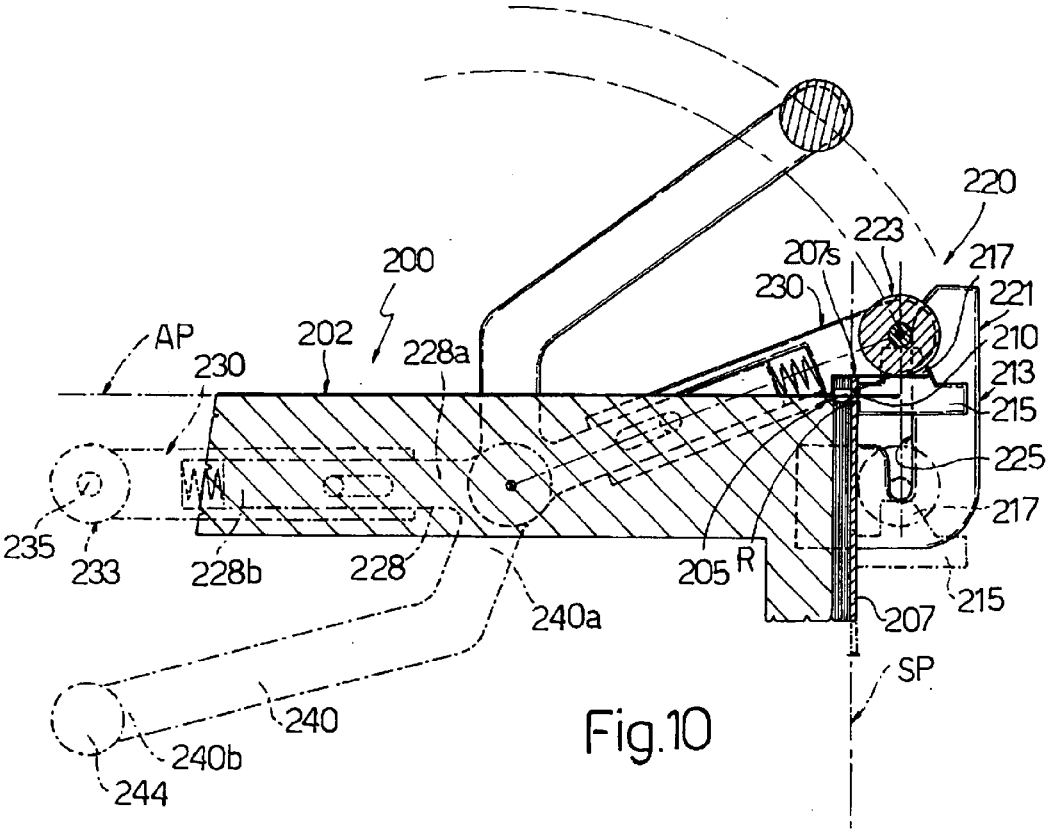
FIG. 10 shows, in a schematic side view, a second variation of .he binding device in FIGS. 1–5.

FIG. 10 shows a further variation of the binding device in FIGS. 1–5. Such binding device comprises a support structure 200 (partially shown) defining a flat rectangular bearing wall (202) on which the binding element 8 rests. The bearing wall 202 is limited, among other things, by a front rectilinear edge 205 arranged facing a flat rectangular bending wall 207 sliding along a sliding plane SP that is perpendicular to the bearing plane AP defined by the bearing wall 202. The bending wall 207 is carried by a support device (not shown) adapted to allow the wall positioning along the plane SP and simultaneously the sliding, with a reversible motion, along such plane SP. The bending wall 207 has a plurality of rectangular through-openings 210 arranged aligned along a rectilinear direction R parallel to an upper rectilinear edge 207*s* of the wall 207.

Bending wall 207 is further connected with an engaging device 213 comprising a flat rectangular appendix 215 extending perpendicularly to wall 207 next to the upper edge 207*s* and provided with a trapezoidal extension 217 whose function will be explained herein below.

The support structure 200 further comprises a guide element 220 comprising a pair of flat shaped walls 221 (only one of such walls is shown) arranged on the sides of the bending wall 207, perpendicular to plane SP and each defining a vertical rectilinear edge 225 parallel to the plane SP and facing such plane.

The binding device in FIG. 10 further comprises a pair of arms 228 having first ends 228*a* hinged on opposite flanges of the support structure 200 on the sides of the bearing wall 202 and second ends 228*b* supporting, by means of a shock-absorbing device 230, end portions of a pressing roller 233 free to rotate around an axis 235 parallel to plane SP.

The first ends 228*a* of the arms 228 are further connected with the first ends 240*a* of second arms 240 having second ends 240*b* mutually interconnected by a crossbar 244.

During use, the pack of sheets 4 is interposed between the support structure 200 and the bending wall 207 with the holes 133 of the pack 4 arranged aligned with the rectangular through-openings 210. The flat sheet element 100 rests on the bearing wall 202 and is arranged coplanar with the bearing plane AP; the tongues 107 are further inserted into the holes 133 of the pack 4 and pass through the bending wall 207 through the opening 210. The closure element 100 is arranged above the upper rectilinear edge 207*s* of the bending wall 207. An operator (not shown) then grasps the crossbar 244 to rotate the arms 228 from a rest position (shown in dotted lines) in which the roller 233 is arranged at the opposite part to the bending wall 207 with respect to the support structure 202 to an operation position in which the arm 230 comes in contact with the extension 217 and simultaneously an end portion of the roller is arranged on the rectilinear edge 225; in such a position the roller 233 also comes in contact with the closure element 110. In its following stroke, roller 233 is guided by element 220 and moves along a rectilinear trajectory T, parallel to the edge 225, to the sliding plane SC and intersects the closure element 110.

The bending wall 207 is then pushed downwards thus bending the tongues 207 and simultaneously the roller 233 bends the closure element 110 and presses it onto the bent tongues 207 and onto the flat end element 130*a*.

Also in this way, if a binding element 8*a* is used, operations are performed similar to those shown with reference to FIG. 12 to realise a bound fascicle.

Figure 13:
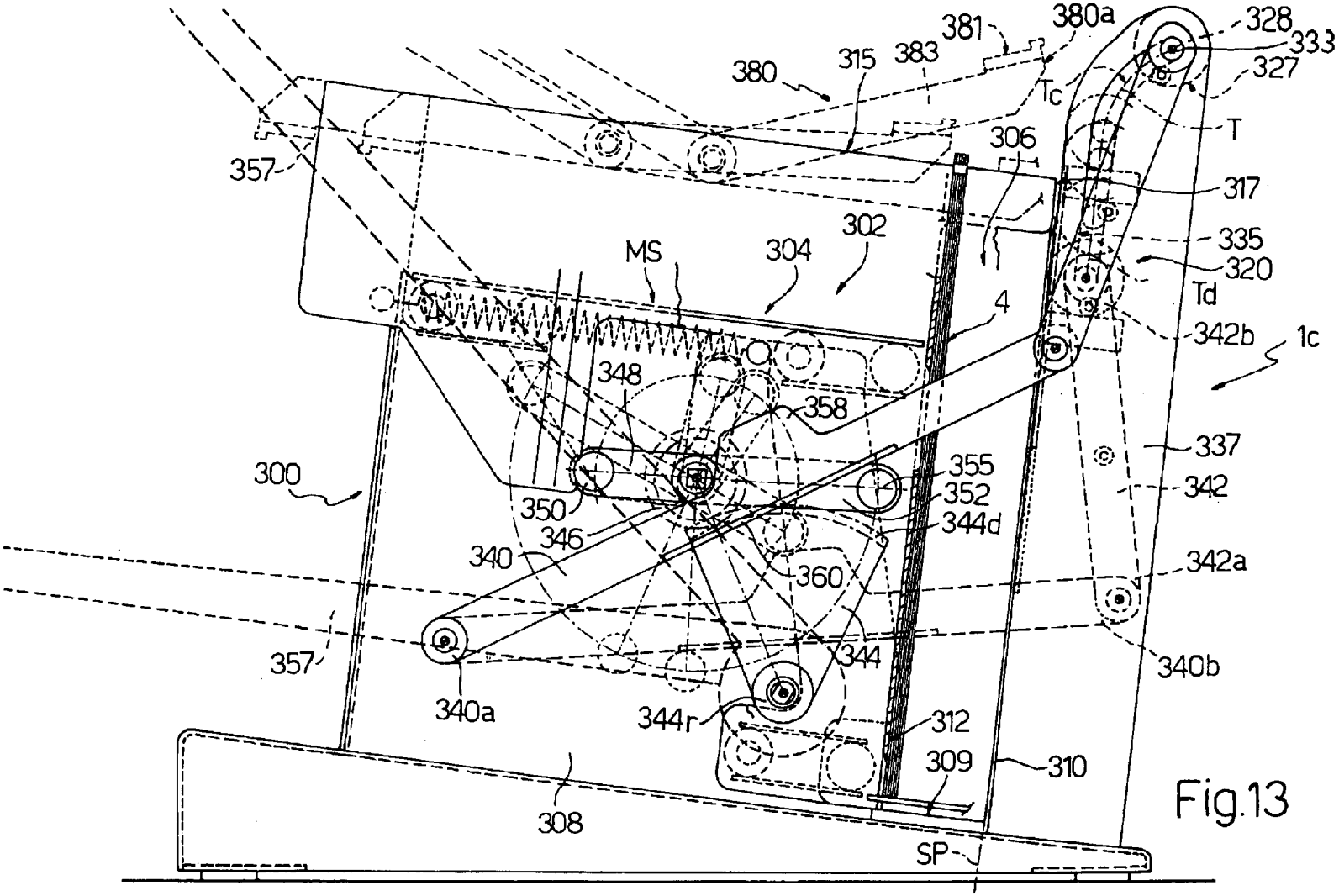
FIG. 13 shows, in a diagrammatic side view, a third variation of the binding device in FIGS. 1–5.

With particular reference to FIG. 13, a third variation 1*c* of the previously described binding device is shown.

The binding device 1*c* comprises a support structure 300 that is preferably made of metal material (for example steel) and defining an internal parallelepiped recess 302 along which a slider 304 made of metal material (for example steel) slides with a reversible motion.

In particular the support structure 300 and the slider 304 define a space of variable sizes 306 adapted to contain the pack of sheets 4. The space of variable sizes 306 is delimited:

- laterally by two lateral walls 308 of the support structure 300,
- on the lower side by a slanted bottom wall 309 of the support structure 300,
- on the front side by a front wall 310 of the support structure 300; and
- on the rear side by a wall 312 of the slider 304 facing and parallel to wall 310.

The variable-sized space 306 shows maximum sizes next to a rear position of the slider 304 for which the walls 310, 312 are mutually separated by a distance D (for example 20 cm) and minimum sizes next to a front position of the slider 304 by which the wall 310, 312 are separated for a distance d (for example 2 cm) that is substantially equal to the thickness of the pack 4 of sheets (obviously d<D).

Figure 14:
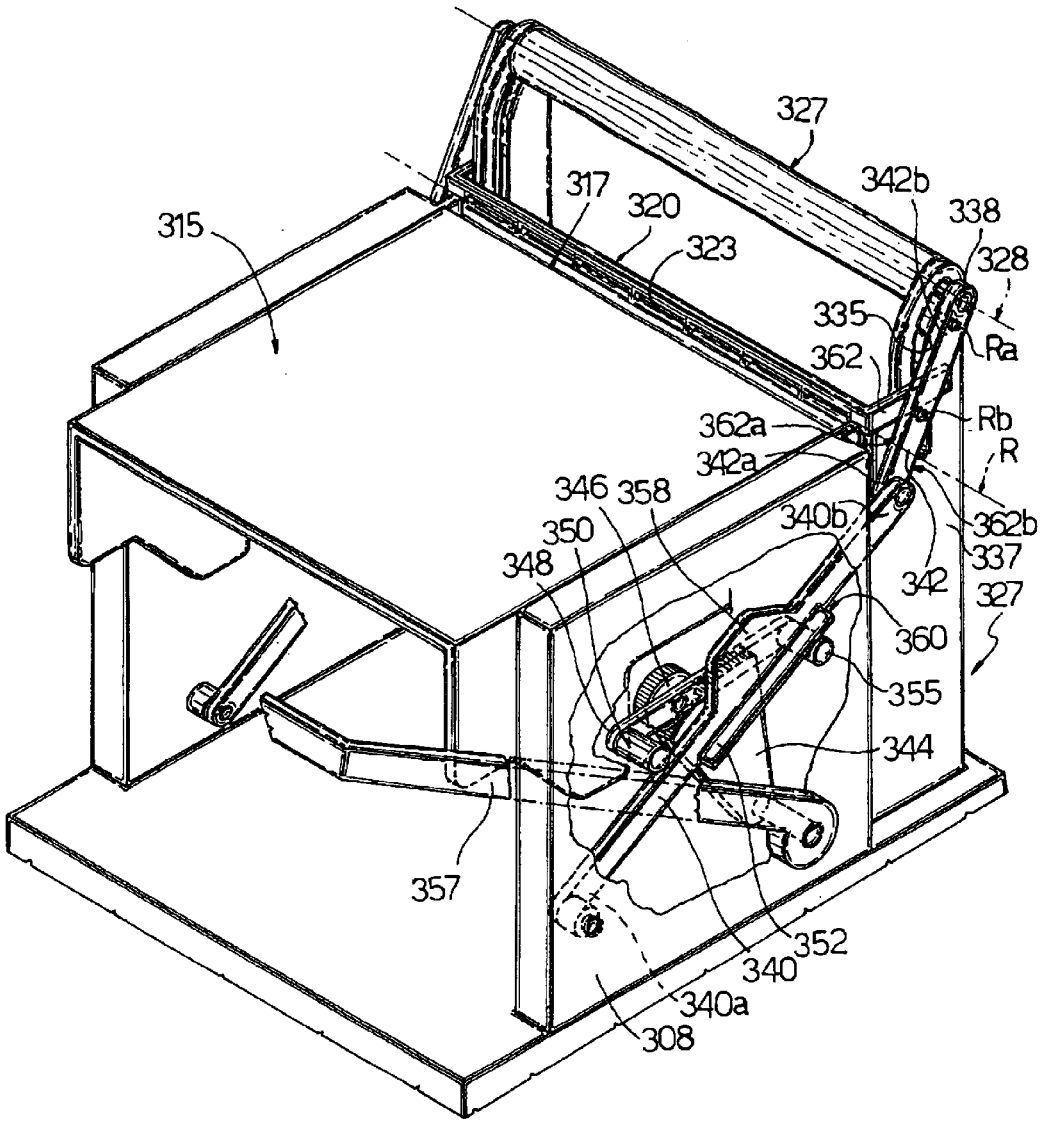
FIG. 14 shows, in a partially perspective view, the binding device in FIG. 13.

Similarly to what has been said with reference to FIG. 10, the support structure 300 (or the slider 304) defines a flat rectangular bearing surface 315 having a small slant (about 15°) with respect to the horizontal plane and adapted to support the binding element 8. The bearing surface 315 is limited, among others, by a front rectilinear edge 317 arranged facing a flat rectangular bending wall 320 sliding, with reversible motion, along a sliding plane SP that is substantially perpendicular to the bearing surface 315. The bending wall 320 is carried by a support device (partially shown in FIG. 14) of the support structure 300 adapted to allow the wall positioning along the plane SP and simultaneously the sliding, with a reversible motion, along such plane SP.

The bending wall 320 shows a plurality of rectangular through-openings 323 arranged aligned along a rectilinear direction R parallel to the front rectilinear edge 317.

A roller 327 is further provided (similarly to what has been shown with reference to FIG. 10) whose rotation axis 328 is arranged parallel to the rectilinear edge 317 and having end cylindrical appendixes 333 coaxial with axis 328 and sliding inside respective elongated slots 335 extending substantially parallel to the sliding plane SC and realised on elongated walls 337 extending perpendicularly to the front wall 310 of the support structure 300. The slots 335 define a trajectory T for the roller 327 comprising a first curved section Tc and a second rectilinear section Td parallel to the sliding plane SC, in such a way that roller 327 moves, along the trajectory section Tc, with the generatrix of the same roller being parallel to the sliding plane SC.

The binding device 1*c* is provided with a handling mechanism for roller 327 and bending wall 320 comprising:

- a first flat rectilinear arm 340 having a first end 340*a* hinged to a lower portion of the lateral wall 308;
- a second flat rectilinear arm 342 having a first end 342*a* hinged to a second end 340*b* of the arm 340 and a second end 342*b* hinged to a cylindrical appendix 333;
- a triangular-section-shaped flat element 344 having an apex portion 344*v* hinged to the lateral wall 308 and a curved side portion 344*d* equipped with teeth (not shown) and coupled with a gear wheel 346;
- a first small arm 348 extending radially from the gear wheel 346 and equipped at its free end with a pair of small resilient rollers 350 that are mutually coaxial and have different diameters;
- a second small arm 352 extending from the gear wheel 346 on the opposite side of the first small arm 348 and also having at its free end a pair of small resilient rollers 355 that are mutually coaxial and have different diameters; and
- a lever 357 extending radially from the sector element 344 and equipped with a graspable end portion.

The rectilinear arm 340 is further provided, next to a central area with a triangular cam portion 358 facing upwards and adapted to cooperate, in the way that will be further explained below, with the pair of small rollers 350. The rectilinear arm 340 further has, next to a central area thereof, a rectilinear tab 360 facing outwards of the support structure 300 and adapted to cooperate, in the ways that will be explained below, with the pair of small rollers 355.

The second rectilinear arm 342 shows a pair of strikers Ra Rb (FIG. 14), approximately, arranged, from opposite bands of a middle portion of the rectilinear arm 342 and both facing the elongated wall 337. The strikers Ra and Rb have a substantially parallelepipedal shape, the same height and are adapted to abut against respective first and second rectilinear larger edge portions 362*a*, 362*b* of a rectangular appendix extending from a vertical edge of the bending wall 320 towards the roller 327 to allow transmitting the motion between the second arm 342 and the bending wall 320 and move the latter along the sliding plane SC.

The position of the binding element 8 is stably kept during binding operations by means of a striker device 380 (FIG. 13) that is arranged, in an activation position thereof (not shown), with a shoulder 380*a* thereof abutting against the closure element 110*a* preventing every translation movement thereof on the bearing plane delimited by the bearing surface 315; in particular, the striker device 180 comprises a rectilinear element 381 defining the above-said shoulder and having opposite ends carried by first ends of small arms 383 (FIG. 1) having second ends hinged to the support structure 300 from opposite parts of the bearing surface 315.

During use, a pack 4 of sheets is arranged in the space 306 with a lower edge of the pack 4 resting against the wall 309 or resting against a vertically positioning device (not shown) similar to the vertically positioning device 45 previously shown.

The binding element 8 is arranged with a flat sheet element 100 resting on the bearing surface 315 and the tongues 107 oriented towards the bending wall 320. In such a position, the slider 304 is located in its rear position, the space 306 has its maximum sizes and the insertion of the pack 4 of sheets s made easier.

The lever 357 is grasped and rotated counter-clockwise and lowered, thereby generating a counter-clockwise rotation of the sector element 344 and the clockwise rotation of the gear wheel 346 dragging along with its motion the first small arm 348.

The angular displacement of the small arm 348 allows achieving the uncoupling of at least one of the rollers of the pair 350 from a shaped shoulder (not shown) of the slider 304 in such a way that the slider 304 is free to move, by the thrust of resilient means MS (schematically shown) interposed between the same slider 304 and the support structure 300 towards its front position according to which the pack 4 is compressed between the walls 312 and 310 and is then stably positioned with respect to the support structure 300.

The tongues 107 are then inserted into the holes 133 of the pack 4 and into the openings 323 going out from the bending walls 320.

In its following stroke, the small arm 348 approaches the cam portion 308 and when at least one roller of the pair 350 is arranged abutting the cam portion 358 the arm 340 is angularly clockwise rotated and displaced downwards. The downwards displacement of the arm 340 is transmitted, via the arm 342, to the roller 327 that slides downwards, guided by slots 335. The downwards displacement of the first arm 340, also involves the downwards displacement of the second arm 342 till the striker Ra is arranged abutting against the vertical edge 362*a* thereby dragging the bending wall 320 along the plane SC and downwards.

In this way, similarly to what has been said with reference to FIG. 10 the downwards movement of the roller 327 also involves (through the above-said interference) the downwards displacement of the bending wall 320 that, during its motion on the sliding plane SC, bends the tongues 107 on the flat end element 130*a* while the roller 327 bends the closure element 110 arranging the gluing band 117 on bent tongues 107 and on the flat end element 130*a*.

Binding of the pack 4 through the binding element 8 is thereby realised.

Similar binding operations can be realised through the binding element 8*a* arranging the tongues 142 inserted onto the holes 133 of the pack 4 and in the openings 323 of the bending wall 320 in such a way that the tongues 142 go out from the same bending wall 320. In such a case, the band element 140 is manually bent to a C shape, towards the roller 327 in such a way that the larger rectilinear edge 143 can be intercepted by the same roller 327 during its downwards motion and second application portion (from which the protection band 146*a* has been removed) can be arranged in contact with bent tongues 142 and flat end element 130*a* of the pack 4 by the action of the roller 327.

At the end of binding operations the lever 357 is again grasped and clockwise rotated and lifted, by creating the clockwise rotation of the sector element 344 and the counter-clockwise rotation of the gear wheel 346 that drags along its motion the second small arm 352.

The angular displacement of the small arm 352 approaches the roller 355 to the arm 340 and when at least one roller of the pair 355 is arranged abutting against the rectilinear tab 360, the arm 340 is angularly counter-clockwise rotated and displaced upwards. The upper displacement of the arm 340 is transmitted, through the arm 342, to the roller 327 that slides upwards guided by slots 335.

Similarly, the upwards displacement of the first arm 340, further includes the upwards displacement of the second arm 342 till the striker Rb is arranged abutting the vertical edge 362*b* thereby dragging the bending wall 320 along the plane SC and upwards. The bending wall 320 is then taken back to a position in which the alignment direction R of the space 323 is substantially coplanar to bearing surface 315.

The first small arm 348 further rotates counter-clockwise till one of the rollers 350 is arranged abutting against a lateral edge (not shown) of the slider 304 which is pushed, through the action of the small arm 348, towards its rear position through the action of resilient means MS.

With reference to FIGS. 15–20, the binding device realised according to the fourth variation, globally defined by the reference number 401, comprises a metal support frame 402 equipped with an intermediate bearing plane 403 arranged substantially slanted with respect to the horizontal plane and adapted to support a plurality of rectangular sheets 404 arranged as a pack.

Each sheet 404 is provided with a plurality of rectangular holes that extend along a rectilinear direction next to a rectilinear larger side edge of the pack. As will be explained in the following description, the holes of sheets 404 are used to allow inserting the tongues 142 of the binding element 8*b* (FIG. 11).

It is anyway clear that the binding device can be used with other binding elements of a known type equipped with flexible tongues arranged as a comb and carried by a flexible flat portion, for example of the type discloses in the Italian Patent Application MI96A002357 filed on Nov. 13, 1996 and bearing the title "Costina per la rilegatura di fascicoli di fogli forati su un bordo".

The device 401 is equipped with a C-shaped lever element 406 comprising a grippable rectilinear rod 406*a* (FIGS. 16 and 17) and to mutually parallel rectilinear arms 406*b* and having end portions hinged with frame 402. The rectilinear arms 406*b* have respective rectilinear grooves 407 within which opposite ends 408*a* of a roller 408 are slidingly assembled, said roller being equipped, at each end thereof, with a gear wheel 409 whose function will be described herein below. The lever element 406 carries two helical springs 406*m* (FIG. 16) each one of which has a first end portion coupled with an end 408*a* of the roller 408 and a second end portion coupled with a pin 410 forming the hinge between the frame 402 and the lever element 406.

Particularly, each pin 410 is arranged next to a frame portion indicated by the reference numeral 411, that is a cam profile for displacement of the roller 408 towards an operation position.

Each arm of the lever element 406 co-operates with a triangular connecting rod 412 that has a central point 413 hinged to a frame 402 and a pin 414 extending from a first end of the connecting rod 412 and is adapted to slide in an arc-shaped slit 415 defined on a vertical upper side wall of the frame 402.

A flat pressing member 416 is hinged to the connecting rod 412 and has grooves 418 within which respective pins 417 slide, each extending from a second end of the connecting rod 412.

A rack member 419 (FIG. 16) is provided next to a front lower portion with the slanted plane 403 of the frame 402.

The flat pressing member 416 is coupled with resilient means 421 carried by the frame 402 and adapted to push the flat pressing member 416 downwards and towards a second plate element 423 (FIGS. 15 and 16) sliding with respect to the frame 402.

The flat pressing member 416 frontally carries a plate element 420 (FIG. 19), sliding with respect to the same flat pressing member 416 and provided with a resilient element 420*a* co-operating with a striker portion of the flat pressing member 416.

The plate element 423 has, next to a front rectilinear edge thereof, a plurality of rectangular holes 424 (FIG. 20) arranged aligned along such edge and intended to be arranged in correspondence of the holes defined on sheets 404 when the pack of sheets is correctly positioned on the bearing plane 403.

The second plate element 423 frontally has, next to each opposite end portions, a pair of appendixes 426 whose shape is approximately triangular adapted to form an abutment, as will be explained further on, for the roller 408 at the end of the stroke thereof along the cam 411 profile.

The second plate element 423 is rearly equipped with a pair of rectangular-shaped elements 427 (FIG. 20), projecting from the same plate element and intended to engage corresponding rectangular seats 428 defined on a fixed portion of an intermediate plane 403. The second plate element 423 is further resiliently connected, through resilient means 430, to the fixed portion and to the intermediate plane 403.

Spacer elements 431 (FIG. 19) are provided along the lateral walls of the frame 402, to adjust the free space to be occupied by the sheets 404 that must be bound. Should such sheets 404 have different sizes, such spacer elements 431 can be positioned or not.

With reference to FIGS. 15–20, the operation of the device 401 is as follows.

Initially, the device is in a rest position (not shown) in which the resilient means 421 keep the flat pressing element 416 pressed and parallel to the second plate element 423. In such a position the pin 414 is located in an upper section of the arc-shaped slit 415.

The lever element 406 is then grasped and rotated towards the rear portion of the frame 402 till a portion of arms 406*b* is arranged in contact with the pins 414 and exerts thereon a force that is suitable to push the pins 414 towards a lower section of the arc-shaped slit 415; in this way, connecting rod 412 rotates lifting a front end of the flat pressing element 416 and moving the latter away from the second plate element 423 through the action of resilient means 421.

Figure 15:
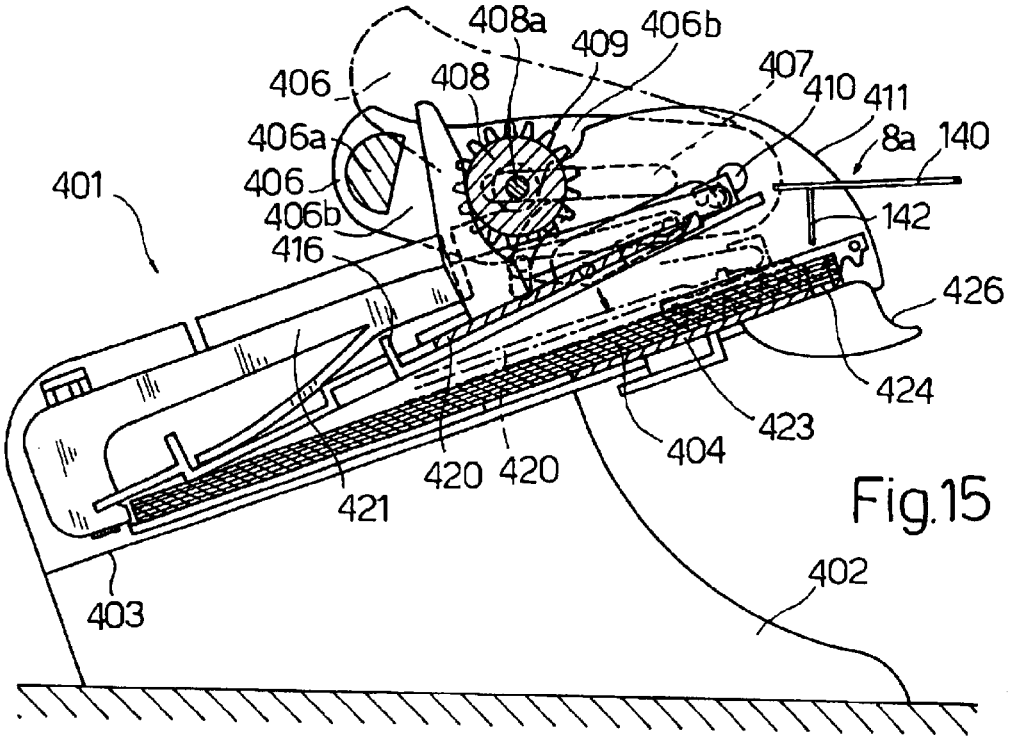
FIG. 15 shows, in a side and in a partially sectional view, a binding device realised according to a fourth variation and arranged in a first operation position.
Figure 16:
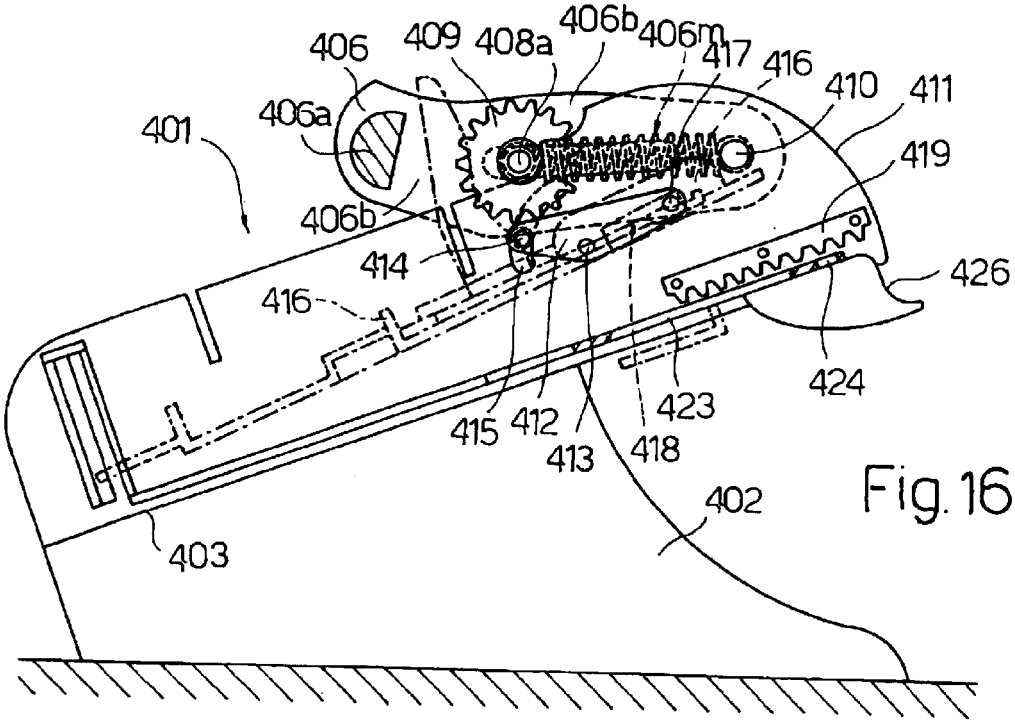
FIG. 16 is a side view of a binding device, shown with some parts removed for description clarity, arranged in the same operation position as in FIG. 15.
Figure 17:
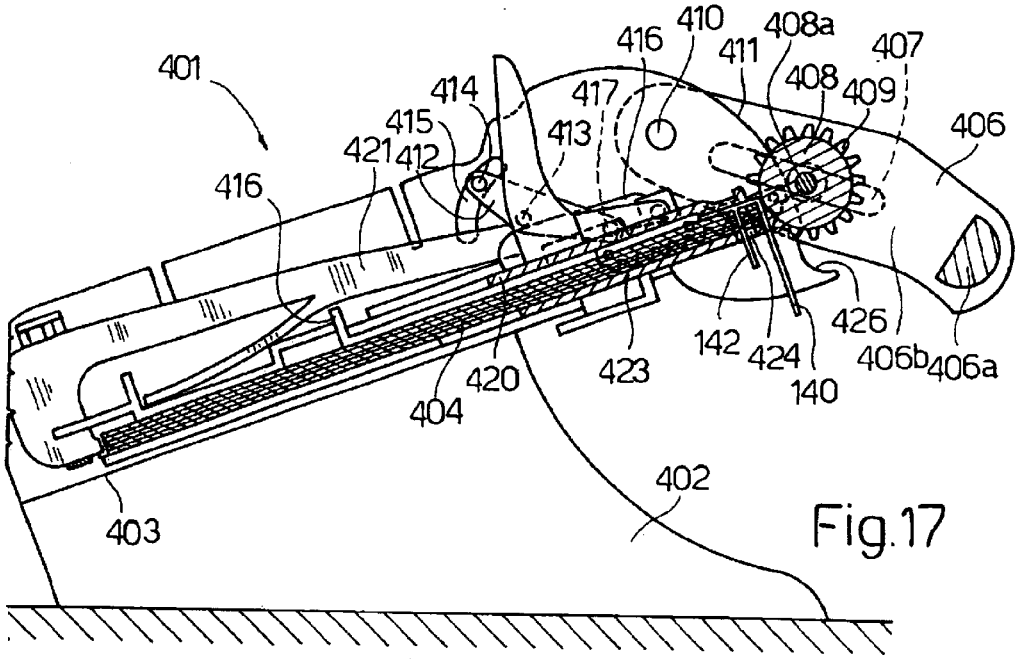
FIG. 17 shows in a partially sectional side view, the device in FIG. 15 arranged in a second operation position.
Figure 18:
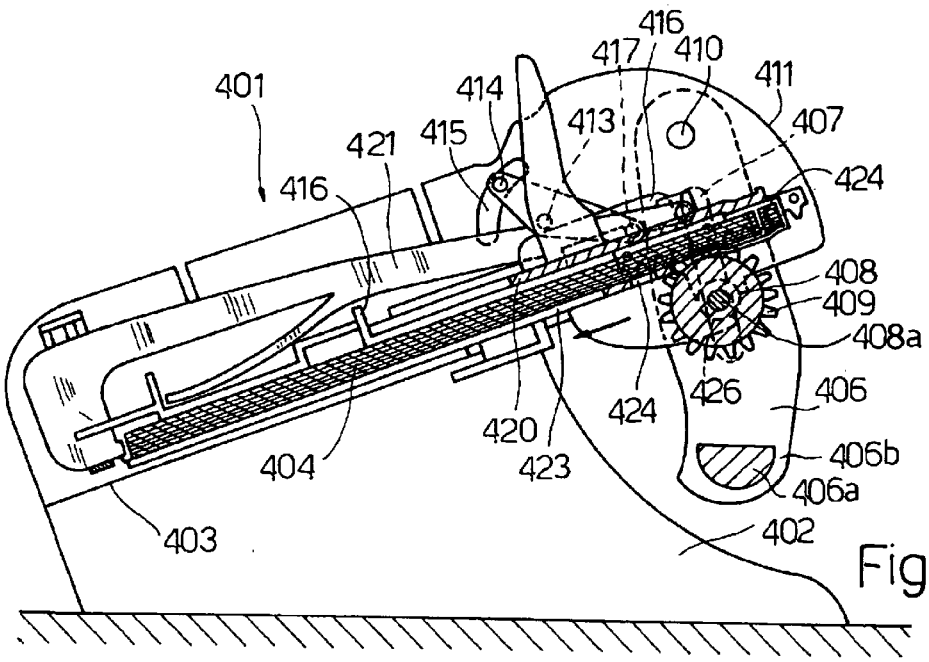
FIG. 18 is a side view of the device in FIG. 15 arranged in a third operation position.
Figure 19:
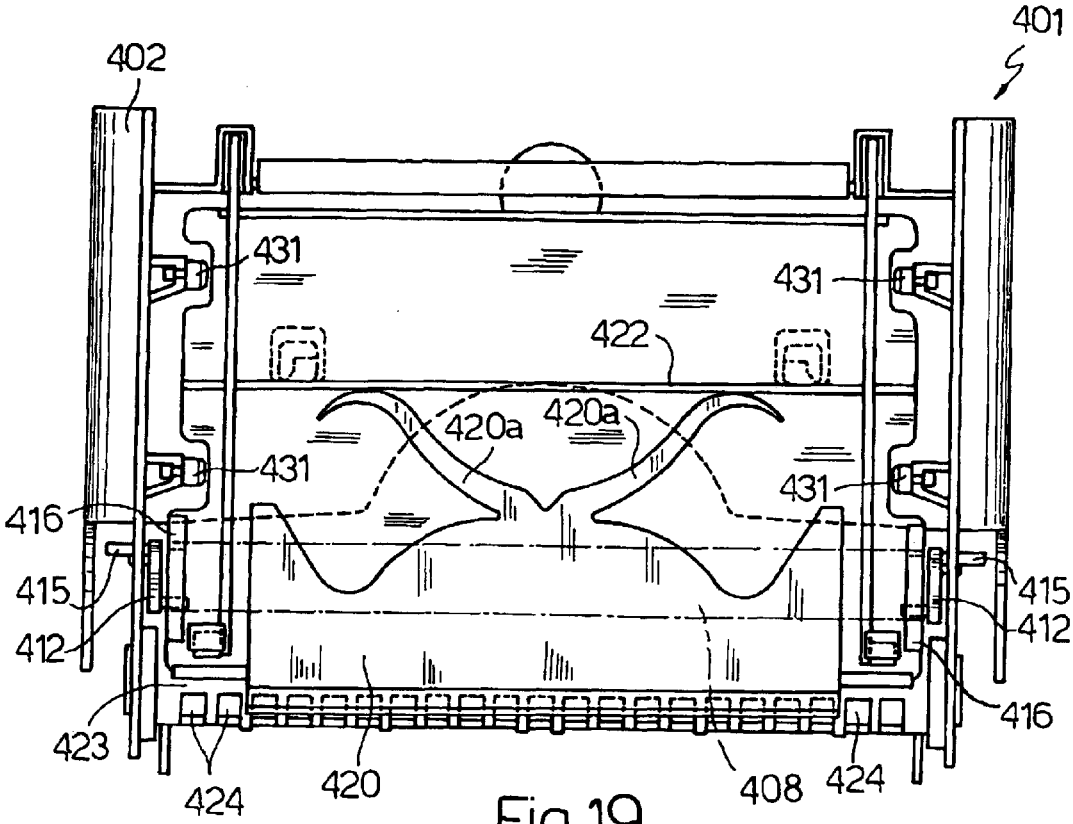
FIG. 19 shows, in a top view, the binding device realised according to the fourth variation.
Figure 20:
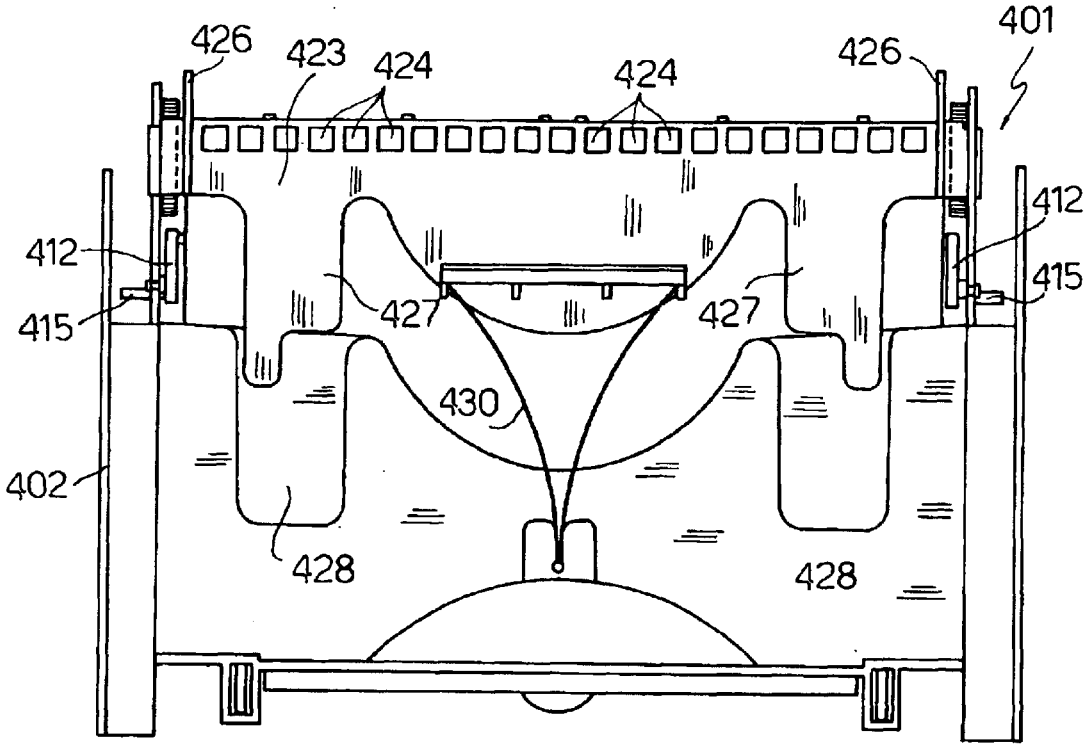
FIG. 20 shows, in a bottom view, the binding device realised according to the fourth variation

In this way, the pack of sheets 404 can be frontally inserted between the flat pressing elements 416 and the plate element 423 and arranged on the intermediate slanted plane 403. In particular, the pack of sheets is placed in such a way that the holes in the sheets correspond to rectangular holes 424 (FIG. 15) of the plate element 423. The tongues 142 of the binding element 8*a* are then inserted into the holes of the pack of sheets and project, for some length thereof, from the holes of the second plate element 423; the band element 140 is then bent in such a way that it forms a 90° angle with the tongues as shown in FIG. 15.

The protection bands 145*a* and 146*a* are then removed.

The pack of sheets 404 is then blocked in a stable position; such blocking operation is performed by acting on the lever element 406 which is rotated towards the front part of the binding device in such a way that the arms 406*b* are uncoupled from the pins 414 and the flat pressing element 416 is pushed by the resilient means 421 downwards resting on an upper face of the pack that is then blocked on the slanted plane 403. The plate element 420 frontally trips to overlap with a front edge portion thereof the band element 140 and prevent a further projection of the tongues 142 from the pack holes.

Afterwards, continuing the angular motion of the lever element 406, the end portions of the roller 408 contact the cam profile 411 (FIG. 17) and follow such cam profile thanks to the presence of springs 406*m*. In this way, the roller 408 moves along a trajectory (FIG. 17) intercepting the band element 140 that is bent by 90° and arranged in contact with a front pack edge with the application portion 145 that is arranged on a front edge of the same pack.

At this time, with a further movement of the lever element 406, roller 408 abuts the appendixes 427 (FIG. 18) in such a way as to exert a force on the second plate element 423 that is pushed towards a rear end of frame 402. Moreover, gear wheels 409 mesh with the rack elements 419 arranged laterally with respect to the stacked sheets 404.

The roller 408 is then displaced towards the rear end of the frame 402 with its axis moving along a plane being parallel to the pack of sheets 404; during such motion, the roller 408 pushes the plate element 402 towards the rear portion of the frame 402 thereby bending the tongues against the lower surface of the block of sheets 404; moreover the roller 408 completes the bending of the band element 140 arranging it on the bent tongues 142.

In this way, the sheets are bound by the band element 140 arranging the application portion 166 on: the bent tongues 142 and on an end sheet that forms a lower face of the pack of sheets 404.

Operations that are quite similar to the above described ones can be carried out with a binding element of the type disclosed in the Italian Patent Application MI96A002357 dated Nov. 13, 1996.

From what has been described above, the advantages of the device according to the invent on are evident, since:

- the binding device with a single operation (and thereby in an extremely reduced time) binds a pack of sheets;
- the binding device requires for its manual operation extremely reduced efforts since these efforts are mainly addressed to the bending of tongues 107 and of closure elements 110, that are made of a flexible and easily bendable material;
- the device does not require critical operations for parts positioning;
- the binding device can bind packs of sheets having different thickness since it is sufficient for the tongues 7 to have a projecting portion from the pack of sheets; and
- the device is structurally very simple and can be very easily and economically realised.

The fascicle realised through the binding device of the present invention has a plurality of advantages among which:

- the closure band 110 does not project with respect to the thickness of the bound fascicle; for this reason it is extremely easy to arrange the fascicle inside a shelf or approach it to other bound fascicles since it has a substantially parallelepipedal shape and is lacking of projecting parts;
- it is possible to put writings and legends by printing on the band 110 that forms, in its central portion, the frontispiece of the bound fascicle;
- it is possible to put writings and legends by printing on the flat sheet element 110*a* that forms, depending on the arrangement of the sheets in the fascicle, the front or rear cover of the bound fascicle;
- the binding device can be realised in a recyclable material, (for example paper material) and should the fascicle be disposed of, for example by incineration, no removal operation of the binding device is required.

It is finally clear that modifications and variations can be performed to the binding device above described without departing from the protection scope of the present invention.

All movements described in the embodiment shown as manual can be obviously realised in an automatic way by means of suitable actuators of a known type, for example actuators operated by electrical motors.

What is claimed is:

1. Device for binding sheets arranged in a pack using a binding element comprising at least one sheet element having along one side thereof a plurality of flexible tongues arranged combwise; said binding element has at least one application surface, said device being characterised by comprising:

housing means for a pack of sheets having through holes arranged aligned along a substantially rectilinear direction; said housing means being adapted to arrange said pack of sheets in a pre-set position to allow inserting said tongues inside said holes; said housing means comprising a variable sized space adapted to house said pack of sheets;

bending means comprising a bending member mobile with respect to said housing means, to bend said tongue portions projecting from said pack on a flat end element forming a face of the same pack, said bending means further bending a portion of said binding element to arrange said application surface overlapping said bent tongues and stably connected with said flat end element forming a bound fascicle; and a support structure and a slider sliding with respect to said support structure; said variable-sized space being defined by portions of said support structure and portions of said slider.

2. Device according to claim 1, characterised in that said slider is mobile with respect to said support structure from a rear rest position to a front operation position to modify at least one size of said space.

3. Device according to claim 2, characterised in that said slider is coupled with return means interposed between the same slider and said support structure and adapted to take the slider towards said rear rest position.

4. Device for binding sheets arranged in a pack using a binding element comprising at least one sheet element having along one side thereof a plurality of flexible tongues arranged combwise; said binding element has at least one application surface, said device being characterised by comprising:

housing means for a pack of sheets having through holes arranged aligned along a substantially rectilinear direction; said housing means being adapted to arrange said pack of sheets in a pre-set position to allow inserting said tongues inside said holes;

bending means comprising a bending member mobile with respect to said housing means, to bend said tongue portions projecting from said pack on a flat end element forming a face of the same pack, said bending means further bending a portion of said binding element to arrange said application surface overlapping said bent tongues and stably connected with said flat end element forming a bound fascicle;

support means for said binding element; and a support structure and a slider sliding with respect to said support structure; said support means being defined by a bearing wall of said slider.

5. Device for binding sheets arranged in a pack using a binding element comprising at least one sheet element having along one side thereof a plurality of flexible tongues arranged combwise; said binding element has at least one application surface, said device being characterised by comprising:

housing means for a pack of sheets having through holes arranged aligned along a substantially rectilinear direction; said housing means being adapted to arrange said pack of sheets in a pre-set position to allow inserting said tongues inside said holes;

bending means comprising a bending member mobile with respect to said housing means, to bend said tongue portions projecting from said pack on a flat end element forming a face of the same pack, said bending means further bending a portion of said binding element to arrange said application surface overlapping said bent tongues and stably connected with said flat end element forming a bound fascicle;

said bending member comprising a bending wall of the mobile type, having at least one through-opening arranged along an alignment direction and adapted to house said tongues; said tongues being adapted to engage said bending wall and being bent following the displacement of said bending wall with respect to said pack of sheets.

6. Device according to claim 5, characterised in that said bending wall is mobile along a sliding plane transversal to a bearing plane adapted to support said binding element.

7. Device according to claim 6, characterised in that said bending wall is available in a rest position in which said alignment direction is substantially coplanar with said bearing plane.

8. Device according to claim 7, characterised in that said bending wall is mobile with a reversible motion from said rest position to an operation position in which said openings are not coplanar with the bearing plane and are spaced from the bearing plane by a prefixed distance.

9. Device for binding sheets arranged in a pack using a binding element comprising at least one sheet element having along one side thereof a plurality of flexible tongues arranged combwise; said binding element has at least one application surface, said device being characterised by comprising:

housing means for a pack of sheets having through holes arranged aligned along a substantially rectilinear direction; said housing means being adapted to arrange said pack of sheets in a pre-set position to allow inserting said tongues inside said holes;

bending means comprising a bending member mobile with respect to said housing means, to bend said tongue portions projecting from said pack on a flat end element forming a face of the same pack, said bending means further bending a portion of said binding element to arrange said application surface overlapping said bent tongues and stably connected with said flat end element forming a bound fascicle;

said bending means comprising a pressing member adapted to engage said binding element to arrange said application surface on the bent tongues from said bending member and on said flat end element.

10. Device according to claim 9, characterised in that said bending member comprises a bending wall of the mobile type having at least one through opening arranged along an alignment direction and adapted to house said tongues; said tongues being adapted to engage said bending wall and being bent following to the displacement of said bending wall with respect to said pack of sheets;

said pressing member being mobile between a rest position and an operation position according to which a flat surface of said pressing member is substantially coplanar with a sliding plane on which the bending wall moves to press said application surface onto said pack.

11. Device according to claim 10, characterised in that said pressing member co-operates with said bending wall to control at least a stroke section of said bending wall following to the movement of said pressing member realising the simultaneous action of arranging the tongues in contact with the flat end element and arranging the application surface in contact with the bent tongues and with the flat end element of said pack.

12. Device for binding sheets arranged in a pack using a binding element comprising at least one sheet element having along one side thereof a plurality of flexible tongues arranged combwise; said binding element has at least one application surface, said device being characterised by comprising:

housing means for a pack of sheets having through holes arranged aligned along a substantially rectilinear direction; said housing means being adapted to arrange said pack of sheets in a pre-set position to allow inserting said tongues inside said holes;

bending means comprising a bending member mobile with respect to said housing means, to bend said tongue portions projecting from said pack on a flat end element forming a face of the same pack, said bending means further bending a portion of said binding element to arrange said application surface overlapping said bent tongues and stably connected with said flat end element forming a bound fascicle;

said bending member comprising a first bending wall mobile on a sliding plane and having at least one through-opening arranged along an alignment direction and adapted to house said tongues;

said tongues being adapted to engage said first bending wall and being at least partially bent following the displacement of said first bending wall with respect to said pack of sheets; said bending means comprising a second bending wall sliding on said sliding plane and having an end edge adapted to intercept a portion of said binding element to press the application surface onto the flat end element and on the at least partially bent tongues.

13. Device according to claim 12, characterised in that said end edge has a rounded profile.

14. Device for binding sheets arranged in a pack using a binding element comprising at least one sheet element having along one side thereof a plurality of flexible tongues arranged combwise; said binding element has at least one application surface, said device being characterised by comprising:

housing means for a pack of sheets having through holes arranged aligned along a substantially rectilinear direction; said housing means being adapted to arrange said pack of sheets in a pre-set position to allow inserting said tongues inside said holes;

bending means comprising a bending member mobile with respect to said housing means, to bend said tongue portions projecting from said pack on a flat end element forming a face of the same pack, said bending means further bending a portion of said binding element to arrange said application surface overlapping said bent tongues and stably connected with said flat end element forming a bound fascicle;

said bending means comprising a bending wall mobile with respect to pack along a sliding plane and having at least one through-opening arranged along an alignment direction and adapted to house the portions of tongues projecting from said pack; said bending wall bending the tongues projecting from said bending walls on said flat end element of said pack; and at least one roller mobile along a trajectory having at least one portion joined to said sliding plane; said roller intercepting along its motion a portion of said binding element to arrange said application surface on the tongues bent by said bending wall and on the flat end element of the pack to form said bound fascicle.

15. Device according to claim 14, characterised in that said binding wall is adapted to co-operate with said roller to realise a connection with motion transmission between said roller and said bending wall and allow the displacement of said bending wall at least along a section of said sliding plane.

16. Device according to claim 15, characterised in that said bending wall comprises at least one portion adapted to realise an abutment for an element co-operating with said roller and mobile with the same roller to realise said connection with motion transmission.

17. Device according to claim 14, characterised in that said roller is carried by a pair of arms having first ends hinged to a support structure of said binding device and second ends supporting said roller.

18. Device according to claim 17, characterised in that it comprises shock-absorbing means interposed between said second ends of said arms and said roller.

19. Device according to claim 14, characterised in that said binding device comprises a support structure and a slider mobile with a reversible motion with respect to said support structure and defining with the same support structure a variable-sized space between a first size in which the slider is arranged in a rear position and the arrangement of said pack inside said space is made easier and a second position in which said slider is arranged in a front position and said pack is stably positioned with respect to said support structure; mechanical connecting and motion transmitting means being provided to link the motion of at least one between said roller and said bending wall with reversible motion of said slider.

20. Device according to claim 19, characterised in that said mechanical connecting and motion transmitting means are adapted to realise displacement of said slider from said first position to said second position, and after reaching the second position, allow moving said bending wall and said roller to bind said pack by means of said binding element.

21. Device according to claim 14, characterised in that it comprises a handling mechanism for said roller and said bending wall comprising:

a first arm having a first end hinged to a support structure of said binding device;

a second arm having a first end hinged to a second end of the first arm and a second end hinged to an appendix extending coaxially with said roller, said appendix being slidable along guide means adapted to displace said roller in parallel with said sliding plane;

an element hinged to said support structure angularly mobile following a command, in particular a manual or electric command, and provided with at least one curved side portion coupled with rotary motion transmission with a central element from which a first small arm radially extends having a free-end thereof adapted to co-operate with said first arm to rotate said first arm according to a first angular direction and realise the movement of said bending wall and of said roller according to a first direction;

said central element having a second small arm extending radially from the same central element and provided with a free end adapted to co-operate with said first arm to realise an angular rotation of said first arm according to a second angular direction and realise the movement of said bending wall and of said roller according to a second direction.

22. Device according to claim 21, characterised in that said first arm has portions adapted to abut against respective portions of an element of said bending wall to move said bending wall according to said first and said second direction.

23. Device for binding sheets arranged in a pack using a binding element comprising at least one sheet element having along one side thereof a plurality of flexible tongues arranged combwise; said binding element has at least one application surface, said device being characterised by comprising:

housing means for a pack of sheets having through holes arranged aligned along a substantially rectilinear direction; said housing means being adapted to arrange said pack of sheets in a pre-set position to allow inserting said tongues inside said holes;

bending means comprising a bending member mobile with respect to said housing means, to bend said tongue portions projecting from said pack on a flat end element forming a face of the same pack, said bending means further bending a portion of said binding element to arrange said application surface overlapping said bent tongues and stably connected with said flat end element forming a bound fascicle;

a striker device adapted to be placed, during operation, in an activation position in which it is arranged in contact with said binding element in such a way that the position of the latter is kept substantially fixed during binding operations.

24. Device according to claim 23, characterised in that said striker device comprises a rectilinear element defining a shoulder being set in abutment on the binding element to prevent translation movements thereof.

25. Device for binding sheets arranged in a pack using a binding element comprising at least one sheet element having along one side thereof a plurality of flexible tongues arranged combwise; said binding element has at least one application surface, said device being characterised by comprising:

housing means for a pack of sheets having through holes arranged aligned along a substantially rectilinear direction; said housing means being adapted to arrange said pack of sheets in a pre-set position to allow inserting said tongues inside said holes;

bending means comprising a bending member mobile with respect to said housing means, to bend said tongue portions projecting from said pack on a flat end element forming a face of the same pack, said bending means further bending a portion of said binding element to arrange said application surface overlapping said bent tongues and stably connected with said flat end element forming a bound fascicle;

said bending means comprising a lever element hinged to a frame of said binding device and a roller carried by said lever element and mobile with respect to the same lever element; said roller being adapted to co-operate with a cam profile of said frame to move with respect to said frame following a rotation of said lever element; the displacement of said roller realizing at least the arrangement of said application surface on said bent tongues.

26. Device according to claim 25, characterised in that said lever element comprises two arms hinged to said frame and equipped with slits within which end portions of said roller are slidingly assembled.

27. Device according to claim 25, characterised in that said roller carries at its ends gear wheels adapted to mesh with rack members carried by said frame.

28. Device according to claim 25, characterised in that it comprises a pressing member operated by said lever element and mobile between a rest position and an activation position in which it exerts a pressure on said pack of sheets.

29. Device according to claim 25, characterised in that it comprises a plate mobile element with respect to said frame and provided with a plurality of holes extending along a free edge thereof, said through-holes of said pack of sheets being adapted to be placed in correspondence with said holes of said mobile plate element with the tongues projecting from the holes of the mobile plate element, said mobile plate element being equipped with stop means adapted to abut against said roller to displace the mobile plate element with respect to said frame and bend the tongue portion projecting from the pack.

30. Method for binding sheets arranged as a pack comprising the steps of:

providing a binding element comprising an application surface and a sheet element having along a side thereof, a plurality of flexible tongues arranged combwise;

arranging as a pack a plurality of sheets provided with through-holes arranged aligned along a substantially straight direction;

housing and positioning said pack;

inserting said tongues inside said holes of said pack; and bending the tongues projecting from said pack on a flat end element forming a first face of the same pack and further bending a portion of said binding element to arrange said application surface overlapping said bent tongues and stably connected with said flat end element forming a bound fascicle, said step of bending further comprising the steps of:

inserting said tongues in a least one opening of a bending wall; and moving the bending wall with respect to said pack by bending said tongues on said pack.

31. Method according to claim 30, characterised in that the step of further bending a portion of said binding element comprises the steps of:

moving a roller with respect to said pack along a prefixed trajectory intersecting a portion of said binding element; and bending a portion of said binding element by means of said roller realising the arrangement with pressure of said application surface on said pack and said bent tongues.

* * * * *